US011105174B2

(12) United States Patent
Daley et al.

(10) Patent No.: US 11,105,174 B2
(45) Date of Patent: Aug. 31, 2021

(54) SYSTEMS AND METHOD FOR RETRIEVABLE SUBSEA BLOWOUT PREVENTER STACK MODULES

(71) Applicant: Cameron International Corporation, Houston, TX (US)

(72) Inventors: Harold Daley, Houston, TX (US); Mac M Kennedy, Houston, TX (US); Michael Urdiales, Montgomery, TX (US); Gerrit Kroesen, Friendswood, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 233 days.

(21) Appl. No.: 15/662,554

(22) Filed: Jul. 28, 2017

(65) Prior Publication Data

US 2019/0032437 A1 Jan. 31, 2019

(51) Int. Cl.

| | |
|---|---|
| ***E21B 33/064*** | (2006.01) |
| ***E21B 33/06*** | (2006.01) |
| ***B63G 8/00*** | (2006.01) |
| ***E21B 34/04*** | (2006.01) |
| ***E21B 41/04*** | (2006.01) |
| ***E21B 33/038*** | (2006.01) |
| *E21B 34/16* | (2006.01) |

(52) U.S. Cl.

CPC ..... *E21B 33/064* (2013.01); *B63G 8/001* (2013.01); *E21B 33/038* (2013.01); *E21B 33/061* (2013.01); *E21B 34/04* (2013.01); *E21B 41/04* (2013.01); *B63G 2008/007* (2013.01); *E21B 34/16* (2013.01)

(58) Field of Classification Search

CPC ..... E21B 33/064; E21B 33/061; E21B 34/16; B63G 8/001; B63G 2008/007

USPC ..... 166/340

See application file for complete search history.

(56) References Cited

U.S. PATENT DOCUMENTS

| | | | |
|---|---|---|---|
| 3,602,300 | A | 8/1971 | Jaffe |
| 3,683,835 | A | 8/1972 | Deslierres |
| 4,721,055 | A | 1/1988 | Pado |
| 4,969,627 | A | 11/1990 | Williams, III |
| 5,069,580 | A | 12/1991 | Herwig et al. |

(Continued)

FOREIGN PATENT DOCUMENTS

| | | | |
|---|---|---|---|
| GB | 2357537 | A | 6/2001 |
| WO | 2015021107 | A1 | 2/2015 |

*Primary Examiner* — Matthew R Buck
*Assistant Examiner* — Patrick F Lambe
(74) *Attorney, Agent, or Firm* — Jeffrey D. Frantz

(57) ABSTRACT

A blowout preventer (BOP) stack module includes a chassis core having a module frame, wherein the chassis core supports one or more submodules each configured to perform a function of a BOP stack, an underwater vehicle coupling hardware coupled to the chassis core, wherein the underwater vehicle coupling hardware couples with an underwater vehicle configured to transport and selectively couple and uncouple the BOP stack module relative to the BOP stack, and a mechanical connector coupled to the chassis core, wherein the mechanical connector couples to a stack frame of the BOP stack, and at least one port coupled to the chassis core, wherein the at least one port is a fluid port, a hydraulic port, a pneumatic port, an electrical port, or a combination thereof, wherein the at least one port couples with a corresponding port of the BOP stack.

20 Claims, 26 Drawing Sheets

(56) References Cited

U.S. PATENT DOCUMENTS 5,235,931 A 8/1993 Nadolink
6,021,731 A 2/2000 French et al.
6,142,233 A * 11/2000 Wilkins ..... E21B 33/038 166/339
6,161,618 A 12/2000 Parks et al.
6,209,565 B1 4/2001 Hughes et al.
6,223,675 B1 5/2001 Watt et al.
6,257,337 B1 7/2001 Wells
6,422,315 B1 7/2002 Dean
6,644,410 B1 11/2003 Lindsey-Curran et al.
6,763,889 B2 6/2004 Rytlewski et al.
6,860,525 B2 3/2005 Parks
7,213,532 B1 5/2007 Simpson
7,216,714 B2 5/2007 Reynolds
7,216,715 B2 5/2007 Reynolds
7,222,674 B2 5/2007 Reynolds
7,690,433 B2 4/2010 Reynolds
8,020,623 B2 9/2011 Parks et al.
8,464,797 B2 6/2013 Singh et al.
8,607,879 B2 12/2013 Reynolds
8,720,579 B2 5/2014 Reynolds et al.
8,727,013 B2 5/2014 Buckley et al.
8,820,410 B2 9/2014 Parks et al.
9,416,628 B2 8/2016 Landrith, II et al.
9,725,138 B2 8/2017 Baylot et al.
9,797,224 B1 10/2017 Stewart et al.
9,862,469 B1 1/2018 Drozd et al.
10,151,151 B2 12/2018 Roper et al.
2002/0040783 A1 4/2002 Zimmerman et al.
2006/0037758 A1* 2/2006 Reynolds ..... E21B 33/035 166/368
2007/0173957 A1 7/2007 Johansen et al.
2010/0307761 A1 12/2010 Buckley et al.
2016/0076331 A1 3/2016 Kalinec et al.
2016/0326826 A1 11/2016 Wood et al.
2018/0029678 A1 2/2018 Peterson et al.
2018/0186438 A1 7/2018 Jamieson
2018/0245417 A1* 8/2018 Miller ..... E21B 33/038
2019/0031308 A1 1/2019 Daley et al.
2019/0032439 A1 1/2019 Smith et al.

* cited by examiner

SYSTEMS AND METHOD FOR RETRIEVABLE SUBSEA BLOWOUT PREVENTER STACK MODULES

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Subsea installations for hydrocarbon drilling or production typically include a rig or vessel disposed at the surface of a body of water. The rig is in communication with a wellhead assembly disposed on a floor of the body of water. A well then extends from the floor of the body of water into the earth to access hydrocarbon deposits. The wellhead assembly typically includes a blowout preventer (BOP) stack to monitor the well and seal the well before a blowout occurs. When a component of the BOP needs servicing, then the BOP is retrieved, causing the well to be taken off-line. The BOP is then diagnosed, repaired, returned to the floor of the body of water, and reinstalled in the wellhead assembly. The well is then brought back online. Because the BOP stack may be disposed at significant depths (e.g., 4,000 feet or more), from the time the well is taken off-line to the time the well is brought back online may be as long as 2-3 weeks, resulting on lost production for an operator of the well.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

The disclosed techniques include performing one or more functions of a subsea BOP stack with one or more modules retrievable by an underwater vehicle (e.g., ROV, AUV, etc.). Each module may include one or more components or submodules that couple to a chassis core of the module. The module may also include connections (e.g., electrical, fluid, hydraulic, pneumatic, etc.) that provide an interface between the module and an adjacent module, the BOP stack, or an underwater vehicle. Accordingly, any function of the BOP stack could be modularized by performing the function with one or more retrievable modules. Further, the BOP stack can be customized by using various modules. The modules may include ancillary systems, which may be added to existing BOP stacks, or primary systems incorporated into designs of new BOP stacks. If a module of the BOP stack breaks or malfunctions, rather than retrieving the entire BOP stack, taking the well off-line for two weeks or more, a replacement module may be assembled on the rig and an underwater vehicle may be sent down to retrieve the old module and install the new module, thus reducing the time the well is off-line to 1-2 days. Further, by assembling a replacement module for the malfunctioning module, the cause of the malfunction can be diagnosed and repaired after the well has been brought back on line. Thus, engineers tasked with repairing BOP stack do not have to work under the intense pressure to get the well back on-line.

Figure 1:
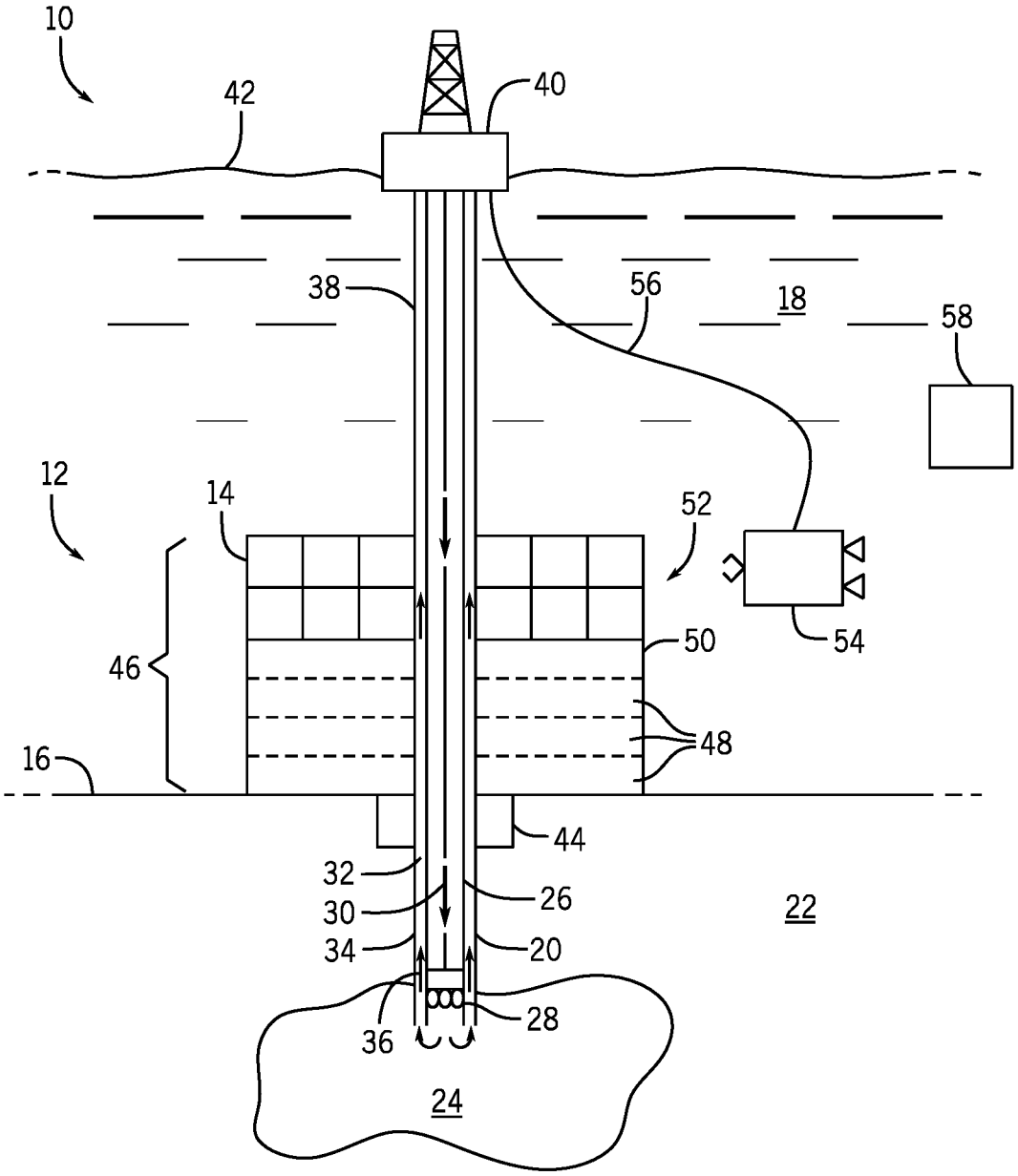
FIG. 1 is a schematic of an embodiment of a subsea installation wellhead assembly.

FIG. 1 is a schematic of a subsea installation 10. The subsea installation 10 includes a well 12. The well 12 includes a wellhead assembly 14 disposed at or near a sea floor 16 of a body of water 18 (e.g., an ocean). A well bore 20 extends from the wellhead assembly 14 through the earth 22 toward a mineral deposit 24. A drill string 26 extends through the wellbore 20 toward the mineral deposit 24. A drill bit 28 disposed in the drill string 26 removes portions of earth 22, forming cuttings, extending the bore hole 20 toward the mineral deposit 24. Drilling fluids (e.g., drilling mud) are pumped down the drill string 26 toward the drill bit, indicated by arrow 30, flushing the cuttings away from the drill bit 28 and into an annulus 32 disposed between the drill string 26 and a casing 34. The cuttings and drilling fluids travel through the annulus 32 in an opposite direction (indicated by arrow 36) as the drilling mud flow through the drill string 26 (indicated by arrow 36). A drilling riser 38 extends from the wellhead assembly 14 to a rig 40 or vessel disposed at a surface 42 of the body of water 18 and may provide passageways for the drilling fluids down to the well 12 and for fluids emanating from the well 12 up to the rig 40.

The wellhead assembly 14 interfaces with the well bore 20 via a wellhead hub 44. The wellhead hub 44 generally may include a large diameter hub that is disposed at the termination of the well bore 20. The wellhead hub 44 provides for the sealable connection of the wellhead assembly 14 to the well bore 20. The wellhead assembly 14 includes a blowout preventer (BOP) stack 46. Though not shown for the sake of clarity and simplicity, it should be understood that the wellhead assembly 14 may include other components or assemblies, such as trees (e.g., Christmas trees, production trees), wellhead connectors, lower and upper marine packages, etc. Further, it should be noted that for clarity, the elements shown in FIG. 1 are not drawn to scale. The BOP stack 46 includes one or more ram BOPs 48 and/or one or more annular BOPs 50. In the instant embodiment, the BOP stack 46 includes three ram BOPS 48 and one annular BOP 50, however, it should be understood embodiments having different combinations of ram BOPs 48 and/or annular BOPs 50 are also envisaged.

The ram BOP 48 includes ram blocks that move toward one another in a plane perpendicular to the axis of the drill string 26 to block or restrict fluid flow through the drill string 26, the annulus 32, or other flow paths through the BOP stack 46. In some embodiments, the ram BOP 48 may be able to open and close like a gate valve to temporarily restrict fluid flow through one or more fluid flow paths of the BOP stack 46. In other embodiments, the ram BOP 48 may shear the fluid conduits through the BOP stack 46 (e.g., the drill string 26, the casing 34, etc.) to more permanently restrict fluid flow through the one or more fluid flow paths of the BOP stack 46.

The annular BOP 50 includes an annular elastomeric seal disposed about the axis of the drill string 26. One or more pistons push on the seal in a direction parallel to the axis of the drill string, causing the seal to radially constrict, stopping or restricting fluid flow through the fluid passages in which it is disposed.

As the well 12 is being drilled, the drill bit 28 may access the mineral deposit 24. If the hydrocarbon fluid of the mineral deposit 24 is under sufficient pressure, the hydrocarbon fluid may flow up the drill string 26, opposite the flow of drilling mud indicated by arrow 30. Such conditions may lead to an increase in pressure, which may potentially cause tubing, tools, and drilling fluid to be blown out of the well bore 20, or otherwise components of the wall 12. When these conditions occur, one or more of the BOPs 48, 50 may be used to temporarily or permanently block or restrict fluid flow through one or more passages of the BOP stack 46.

The BOP stack 46 may include one or more modules 52 that assist in control or otherwise facilitate operation of the BOPs 48, 50. These modules 52 may include ancillary systems and/or primary systems. Ancillary systems may be defined as one or more modules that can be added to an existing BOP stack. Ancillary systems may include, for example, accumulators, filters, rigid conduit manifolds, deadman/autoshear systems (DMAS), regulators, acoustic controls, pilot modules, sensor packages, command systems, junction systems, battery systems, etc. Primary systems are modules or groups of modules that are included in a BOP stack by design from the outset. Primary systems, beyond those listed as examples of ancillary systems, and may potentially include, for example, intervention/non-standard control systems, such as non-drilling control and seabed intervention, as well as various BOP control systems.

As illustrated in FIG. 1, the modules 52 may be installed or retrieved individually or in groups by an underwater vehicle, in this instance a remotely operated underwater vehicle (ROV) 54. It should be understood, however, that the disclosed techniques may be applied to underwater vehicles beyond ROVs. Accordingly, though the disclosed embodiments use ROVs, it should be understood that embodiments using other classes of underwater vehicles (such as autonomous underwater vehicles (AUVs) and the like) are also envisaged. The ROV 54 may be in communication with the rig 40 via an umbilical cord 56. The umbilical cord 56 may provide power, control signals, data, etc. to the ROV 54. In some embodiments, the ROV 54 travels back and forth between the rig 40 and the well head assembly 14 to deposit and retrieve modules 52, or otherwise service the well head assembly 14. In other embodiments, an intermediate docking station 58 may provide a place to temporarily store modules 52 and/or dock the ROV 54 when not in used. In such embodiments, a second ROV 54, or the single ROV 54 may be used shuttle payloads between the rig 40 and the intermediate docking station 58, and between the intermediate docking station 58 and the wellhead assembly 14.

Typically, when a component of the BOP stack 46 needs servicing, the well 12 has to be taken off-line and the entire BOP stack 46 has to be retrieved to the surface 42. Once at the surface 42, the BOP stack 46 is inspected and the problem is identified. In some cases, replacement parts may need to be ordered and delivered. The parts in question are replaced and tests are performed. Once the BOP stack 46 is repaired, the whole BOP stack 46 is returned to the sea floor 16 and operations are resumed. This process leaves the well 12 off-line for one week, two weeks, three weeks, or even longer. Further, because repairs and maintenance to the BOP stack 46 take the well 12 off-line for long periods of time, an operator may wait to make repairs or perform maintenance until multiple operations need to be performed. By incorporating some or all of the functions into retrievable modules, when a problem arises with a module, a replacement module may be assembled on the rig 40 or retrieved from storage on the rig 40. The ROV 54 may then retrieve the existing module 52 (e.g., needing service) and install the new replacement module 52. The well 12 may then be brought back on line after one or two days off-line. In some embodiments, the well 12 may be able to continue on-line (e.g., no downtime), or only be off-line for a short period of time (a few seconds or minutes). For examples, for some modules 52 (modules that are rarely used or not critical), the well 12 may continue on-line as the module 52 is removed and replaced. In other embodiments, the BOP stack 46 may have one or more spare receptacles that allow the replacement module 52 to be installed before the existing module 52 is replaced, resulting in little or no time off-line. With the well 12 back on line, the removed module 12 may be inspected, the problem identified, and replacement parts ordered if necessary. In other embodiments, modules 52 may be used to customize the BOP stack 46 or to add functionality to an existing BOP stack 46.

Figure 2:
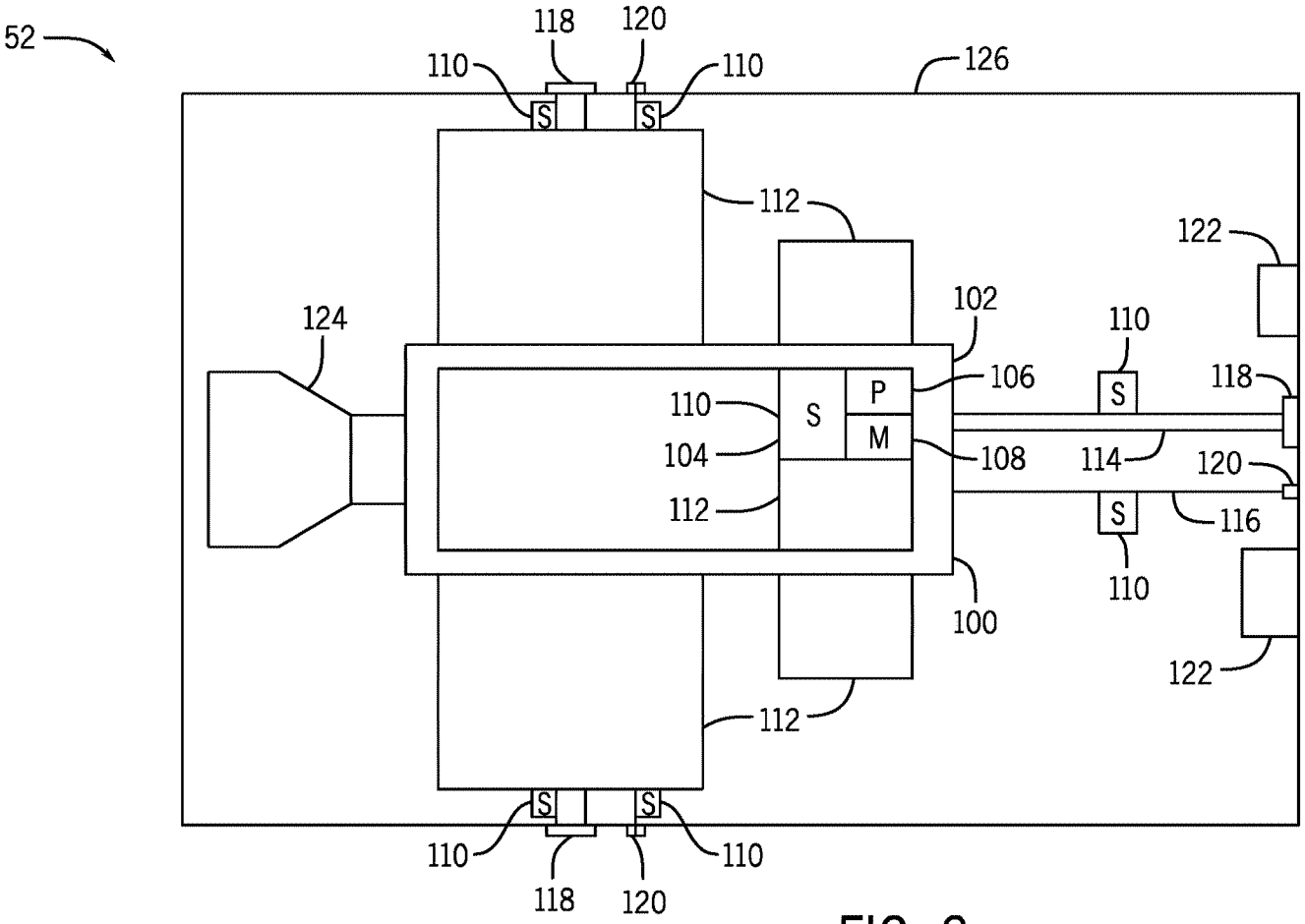
FIG. 2 is a schematic of an embodiment of a retrievable module used in the subsea installation wellhead assembly shown in FIG. 1.

FIG. 2 is a schematic of a module 52 as shown in the BOP stack 46 of FIG. 1. As illustrated, the module 52 is built around a chassis core 100, which includes a frame 102, to which various components may be mounted. In the illustrated embodiment, the frame 102 is generally box-shaped, however the frame 102 may be any shape. In some embodiments, a control system 104 may be coupled to the frame 102 and may be configured to control the operation of the module 52. The frame 102 may include interface geometry, such as tabs, tracks, tapered grooves, indentions, detents, snap fittings, guides, rails, brackets, etc. that act as an interface between the frame 102 and the BOP stack 46, or components/modules that couple to the frame 102. The control system 104 may include various electronic, such as, for example, a processor 106, a memory component 108, and one or more sensors 110. The processor 106 may receive data from the sensors 110 distributed throughout the module 52, or access data stored on the memory component 108, run programs stored on the memory component 108, and then control the operation of the module 52 by generating control signals. In some embodiments, data may be processed and then stored on the memory component 108. The module 52 may also include one or more sub-modules or components 112 coupled to the chassis core 102. The sub-modules 112 or components may be one or more families of assemblies sharing common shapes, dimensions, sizes, connectors, etc. As previously discussed, modules may be designed and assembled to perform a wide range of functions for the BOP stack 46. As such, the rig 40 may have a supply of spare subcomponents 112 and other miscellaneous module 52 components such that a spare module 52 may be assembled on the rig 40 when a module 52 malfunctions, or such that in the event of a module 52 malfunction, the malfunctioning module 52 may be replaced with the spare module 52 by the ROV 54, minimizing the amount of time that the well 12 is off-line. Accordingly, the functionality of the various sub-modules 112 may vary dependent upon the intended function of the module 52. For example, the sub-modules 112 may include valves, filters, batteries, hydraulic accumulators, batteries, capacitors, fluid conduits, manifolds, electronics, sensors, transducers, switches, ram blocks, various control systems, timing systems, counters, triggers, seals, connectors, various electronic, pneumatic, hydraulic, or plumbing components, additional components, or some combination thereof. Further, the equipment to perform some functions of the BOP stack 46 may be spread across multiple modules, to increase modularity, because the equipment may not fit within the footprint of the module 52, or for some other reason. Accordingly, the number of possible module 52 configurations, each heaving a different combinations of sub-modules is nearly infinite. Specific examples of a few possible module 52 configurations are discussed in more detail below. However, it should be understood that these described embodiments are just a few possible examples of many envisaged possible embodiments.

The various sub-modules 112 may be in communication (e.g., electronic, hydraulic, fluid, pneumatic, etc.) with one another and/or with adjacent modules. Accordingly, the module 52 may include fluid conduits 114 (e.g., hydraulic conduits, pneumatic conduits, plumbing conduits) and electrical lines 116 distributed throughout the module 52, connecting various sub-modules 112 and/or the module control system 104. Fluid connectors 118 and electrical connectors 120 may removably couple the fluid conduits 114 and the electrical lines 116 to adjacent modules 52 or to other components within the BOP stack 46. Each connector 118, 120 may include a male connector configured to mate with a female connector, or vice versa. The connectors 118, 120 may include, for example, wet-mate connectors, inductive couplers, packer seals, hydraulic couplers, valves, etc. Though only a single fluid connector 118 and a single electrical connector 120 are shown on each side of the module 52, it should be understood that this is for simplicity and clarity and that each set of connectors 118, 120 and conduits 114, 116 may include multiple connectors 118, 120 and multiple conduits 114, 116. For example, a shuttle valve module 52 may include two fluid input connectors 118 and one fluid output connector 118. Further, if the module has hydraulic connectors and plumbing connectors for fluid, the module may include multiple sets of fluid conduits 114 and fluid connectors 118, each including one or more fluid connectors 118 and one or more conduits 114, for each type of fluid. Similarly, the module 52 may include multiple sets of electrical connectors 120 and electrical lines 116 for different functions (e.g., power, communication, control, etc.).

The module 52 also includes one or more mechanical connectors or latches 122, which facilitate coupling of the module 52 to the BOP stack 46. Each connector 122 may include a male connector configured to mate with a female connector, or vice versa. In some embodiments, the BOP stack 46 may include complimentary geometry or latches that interface with the latches 122 to couple the module 52 to the BOP stack 46. In other embodiments, the latches 122 may merely couple to a component of the BOP stack 46 without the use of a complimentary part on the BOP stack 46.

The module 52 may be deposited in or retrieved from the BOP stack 46 by the ROV 54. Accordingly, the module 52 may include interfacing geometry configured to interface with the ROV 54 (e.g., a tool interface). In the illustrated embodiment, the module 52 has a torque tool bucket 124 disposed opposite the latches 122, which interfaces with a torque tool of the ROV 54. Though the illustrated embodiment utilizes a torque tool and torque tool bucket 124, it should be understood that other assemblies may be used as an interface between the module 52 and the ROV 54.

As is discussed in more detail below, the module 52 may also include a floatation device 126 for managing the buoyancy of the module 52 as the ROV 54 carries the module 52 between the wellhead assembly 14 and the rig 40 of the intermediate docking station 58. Specifically, the ROV 54 may have thrusters capable of controlling the depth of the ROV as long as the ROV is within a threshold value of neutrally buoyant. As such, when the ROV 54 picks up or drops off the module 52, the buoyancy of the package (i.e., the ROV 54 and its payload) may move outside the buoyancy window in which the ROV 54 can control its own depth. For example, when the ROV 54 deposits the module 52, the reduction in mass of the package may cause the buoyancy of the ROV 54 to rise above the threshold value of neutrally buoyant such that the thrusters would be unable to control the depth of the ROV 54 as it floats away. Correspondingly, when the ROV 54 retrieves the module 52, the increase in mass of the package may cause the buoyancy of the ROV 54 to drop below the threshold value of neutrally buoyant such that the thrusters would be unable to lift the ROV 54 back up to the rig 40 or the intermediate docking station 58. Attaching the floatation device 126 to the module 52 to offset the lack of buoyancy due to the weight of the module 52 helps to mitigate the increase in buoyancy associated with dropping off the module 52 and the reduction in buoyancy associated with picking up the module 52.

Figure 3:
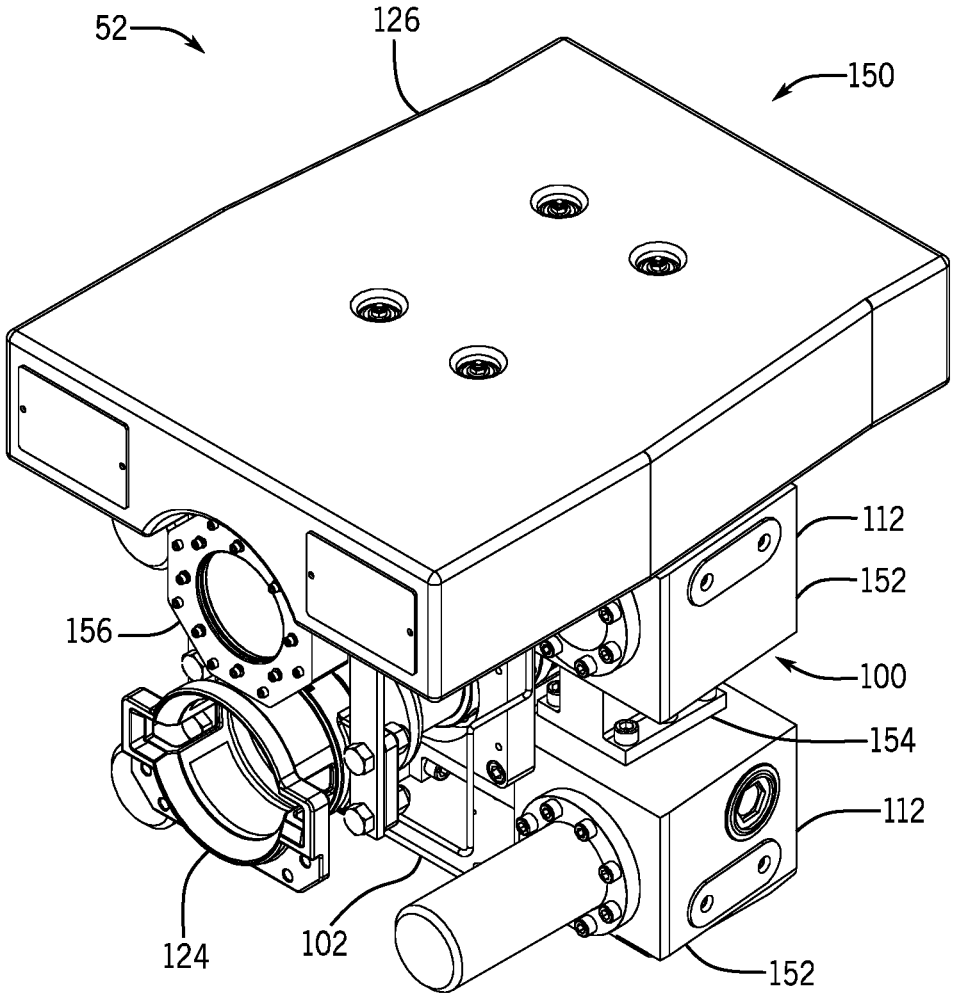
FIG. 3 is a perspective view of an embodiment of a filter module.

FIG. 3 is a perspective view of an embodiment of a filter module 150. The filter module may be configured to receive fluid via one or more fluid inlets, filter the fluid, and output fluid via one or more fluid outlets. As illustrated, the filter module 150 includes four submodules 112, in this embodiment filter manifolds 152, which may be fluidly coupled to one another via junction manifolds 154. As will be described in more detail below, based on the how the filter manifolds 152 are configured and coupled to one another via the chassis core 100 and the junction manifolds 154, the filter manifolds 152 may be aligned in series, in parallel, or some combination thereof, along a fluid flow path through the module 150. The filter module 150 also includes a differential pressure gauge 156, which may measure pressure differences between one or more fluid inlets of the module 150 and one or more outlets of the module 150, or various locations along one or more fluid flow paths through the filter module 150. In some embodiments, the filter module 150 may also include one or more sensors 110 distributed throughout the filter module 150, for example to measure the cleanliness of fluid and/or filter performance in the module 150. For example, the sensors 110 may include pressure sensors, particulate content, or concentration sensors, viscosity sensors, flow rate sensors, or any combination thereof. By further example, two or more sensors 110 of the same type may be used to determine a change in the sensed parameter through the module 150 between the inlets and outlets. Based on measurements taken by the sensors 110, decisions may be made regarding when to replace filters 152, the position of valves that control flow rates through the module 150, etc.

The filter module 150 also includes the torque tool bucket 124, which interfaces with a torque tool of the ROV 54 to couple and decouple the filter module 150 from the ROV 54. As previously discussed, the filter module 150 also includes the floatation device 126, in this embodiment a block of syntactic foam. The floatation device 126 increases the buoyancy of the filter module 150, such that the ROV 54 is capable of shuttling the filter module 150 between the rid 40 (or the intermediate docking station 58) and the wellhead assembly 14.

Figure 4:
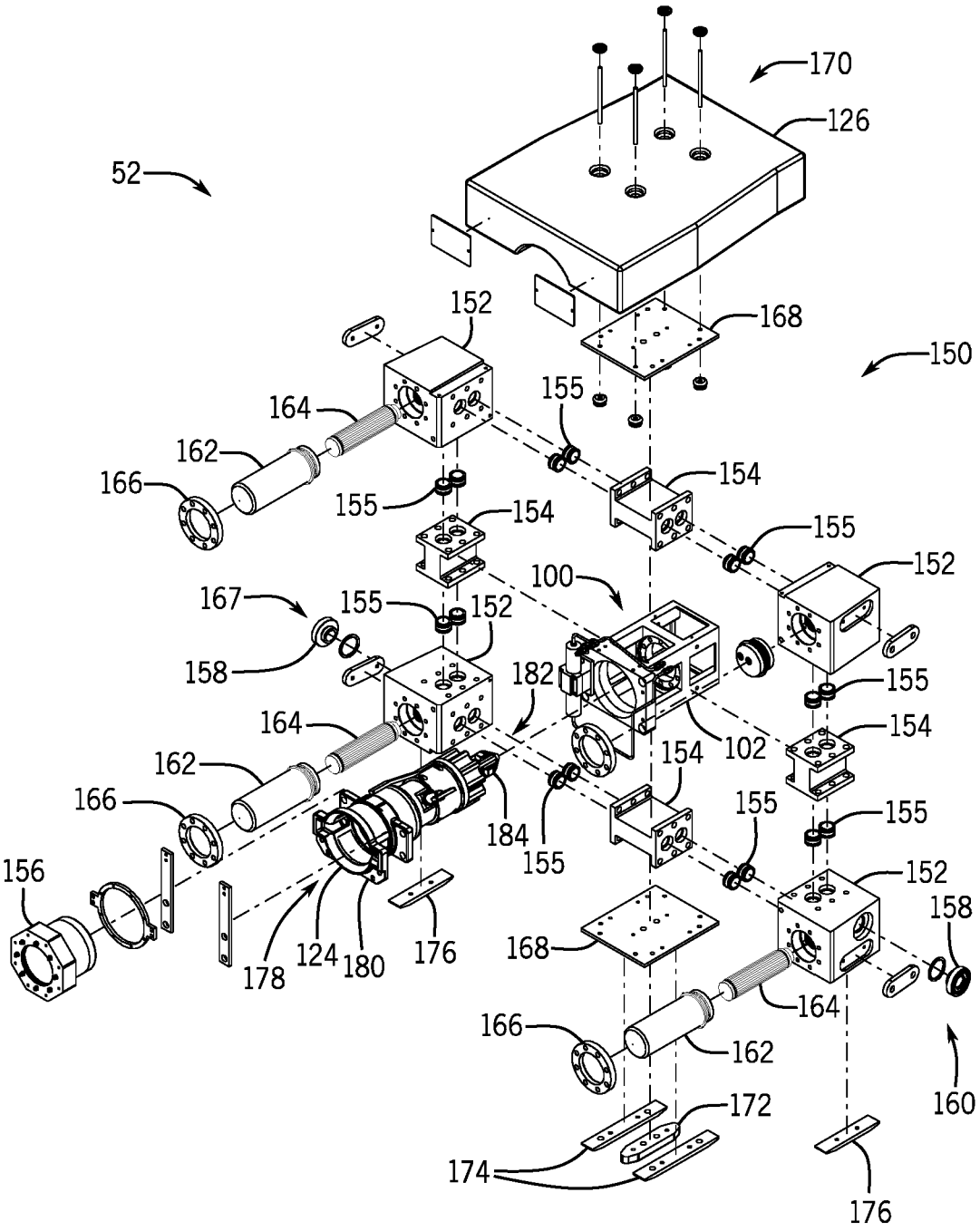
FIG. 4 is an exploded view of an embodiment of the filter module of FIG. 3.

FIG. 4 is an exploded view of an embodiment of the filter module 150 shown in FIG. 3. As previously described, the filter manifolds are disposed about the chassis core 100 and coupled to one another via the junction manifolds 154. In some embodiments, sealing members 155 (e.g., seal subs) may be disposed at the interfaces between filter manifolds 152 and junction manifolds 154. A fluid flow is received from the BOP stack 46 or from an adjacent module 52 via packer seals 158 at one or more fluid inlets 160. One or more of the filter manifolds include a filter bowl 162, which contains a filter element 164, coupled to the filter manifold 152 via a collar 166. The various filter manifolds 152 may have the same filter elements 164 or different filter elements 164 (e.g., filter elements of different coarseness to filter different sized particulate, or filter elements designed to filter out different substances). The fluid may follow a fluid flow path through the various filter manifolds 152 and junction manifolds 154 toward one or more fluid outlets 167, which may include packer seals 158.

Auxiliary mounting plates 168 may be coupled to one or more sides of the chassis core 100 for mounting various additional components. For example, in the instant embodiment, an auxiliary mounting plate 168 is mounted to the top of the chassis core 100 and configured to couple to the floatation device 126 via one or more fasteners 170. A second auxiliary mounting plate 168 may be mounted to the bottom of the chassis core 100 and configured to couple to a module guide 172 (e.g., axial guide) and a pair of primary runners 174 (e.g., friction reducing axial slides), which may help guide alignment and/or provide smooth movement (e.g., reduced friction) of the module 150 during installation into a receptacle in the ROV 54 or the BOP stack 46. In some embodiments, secondary runners may also be mounted on various sub-modules 112 or components of the module 52. For example, in the illustrated embodiment, secondary runners 176 (e.g., friction reducing axial slides) are mounted to the bottoms of two of the filter manifolds 152 to further facilitate installation of the filter module 150. The module guide 172 and the runners 174, 176 may be made of the same materials or different materials. For example, the module guide 172 and the runners 174, 176 may be made of a low-friction polymer, such as Polyoxymethylene (POM, also known as acetal, polyacetal, and polyformaldehyde), Polytetrafluoroethylene (PTFE), a metal, or some other material.

As shown, the torque tool bucket 124 extends into the chassis core 100. The torque tool bucket 124 is configured to interface with the torque tool of the ROV 54 as the ROV couples to, and decouples from, the filter module 150. At a front end 178 of the torque tool bucket 124 is a latch 180 (e.g., a parker latch), which may be actuated by the ROV 54. At a back end 182 of the torque tool bucket 124 is a latch stab 184, which actuates a latch for coupling the filter module 150 to the BOP stack 46.

Figure 5:
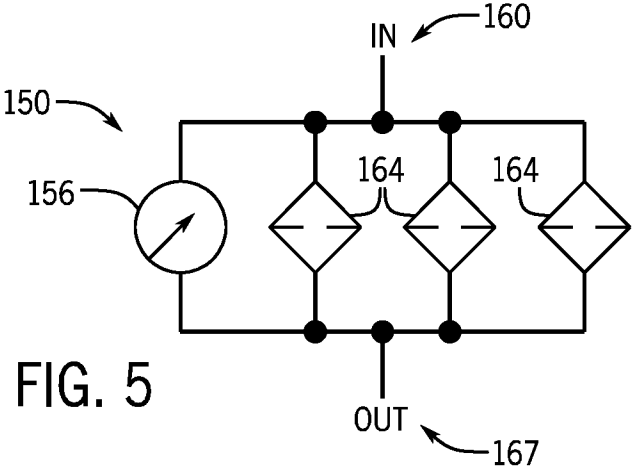
FIG. 5 is a schematic of a flow path through an embodiment of the filter module of FIGS. 3 and 4.

It should be understood that the filter module 150 shown in FIG. 4 is merely one possible envisaged embodiment and is not intended to limit the scope of the claims. Accordingly, the disclosed techniques may be utilized in modules 52 having different components in different configurations, for performing different functions. Further, one or more sub-modules may be used for each of the elements, flow paths (e.g., serial or parallel), etc., enabling customization of the module onsite (e.g., on the rig) for a desired purpose. FIGS. 5-8 illustrate four of many possible envisaged configurations of the filter module 150. FIG. 5 is a schematic of a flow path through an embodiment of the filter module 150. As illustrated, three filters 164 and the differential pressure gauge 156 are in parallel with one another. Fluid enters the filter module 150 via the inlet 160, flows through one of the three filters 164, and then exits the filter module 150 via the exit 167. Based on the readings of the differential pressure gauge 156 (e.g., differential pressure between inlet and outlet increases as filters 164 clog) may be used to determine when filters 164 should be cleaned or replaced.

Figure 6:
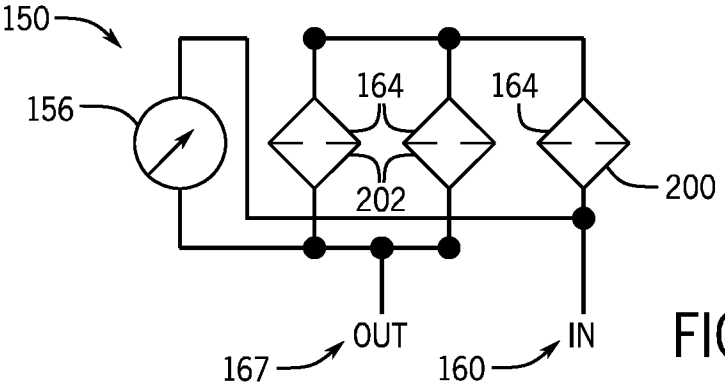
FIG. 6 is a schematic of a flow path through an embodiment of the filter module of FIGS. 3 and 4.

FIG. 6 is a schematic of a flow path through an embodiment of the filter module 150. Fluid enters the filter module 150 via the inlet 160, flows through a coarse filter 200 (e.g., a screen that filters out larger particulate) and then proceeds through one of two fine filters 202 (e.g., filtering out smaller particulate) in parallel. The fluid exits the filter module 150 via the exit 167. The differential pressure gauge 156 is fluidly coupled to the fluid flow path upstream of the coarse filter 200 and downstream of the fine filters 202. Based on the readings of the differential pressure gauge 156 (e.g., differential pressure between inlet and outlet increases as filters 164 clog) may be used to determine when filters 164 should be cleaned or replaced.

Figure 7:
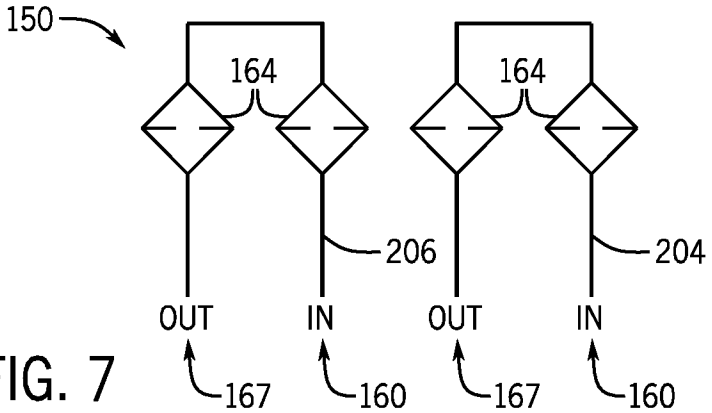
FIG. 7 is a schematic of a flow path through an embodiment of the filter module of FIGS. 3 and 4.

FIG. 7 is a schematic of first and second flow paths 204, 206 through an embodiment of the filter module 150. Fluid enters the filter module 150 via one or two inlets 160, flows through two filters 164 in series and then exits the filter module 150 via one of two exits 167. In the illustrated embodiment, the two flow paths 204, 206 are totally separate from one another. The filter module shown in FIG. 7 also lacks a differential pressure gauge 156.

Figure 8:
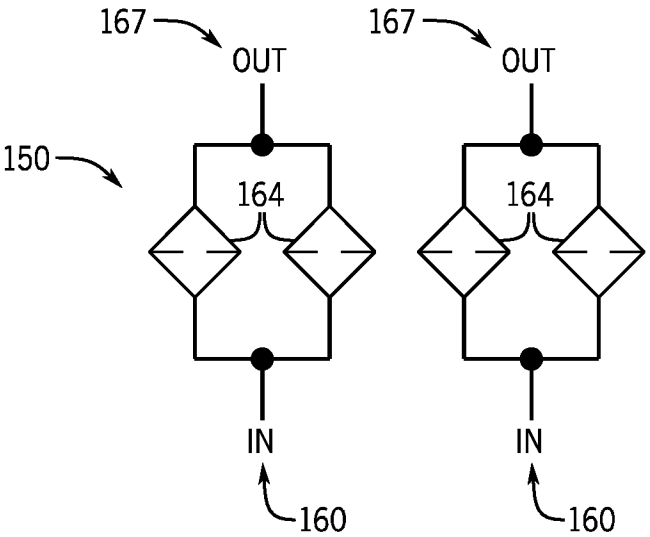
FIG. 8 is a schematic of a flow path through an embodiment of the filter module of FIGS. 3 and 4.

FIG. 8 is a schematic of first and second flow paths 204, 206 through an embodiment of the filter module 150. Fluid enters the filter module 150 via one or two inlets 160, flows through one of two filters 164 in parallel and then exits the filter module 150 via one of two exits 167. In the illustrated embodiment, the two flow paths 204, 206 are totally separate from one another. The filter module shown in FIG. 7 also lacks a differential pressure gauge 156, through some embodiments may include a differential pressure gauge 156.

Figure 9:
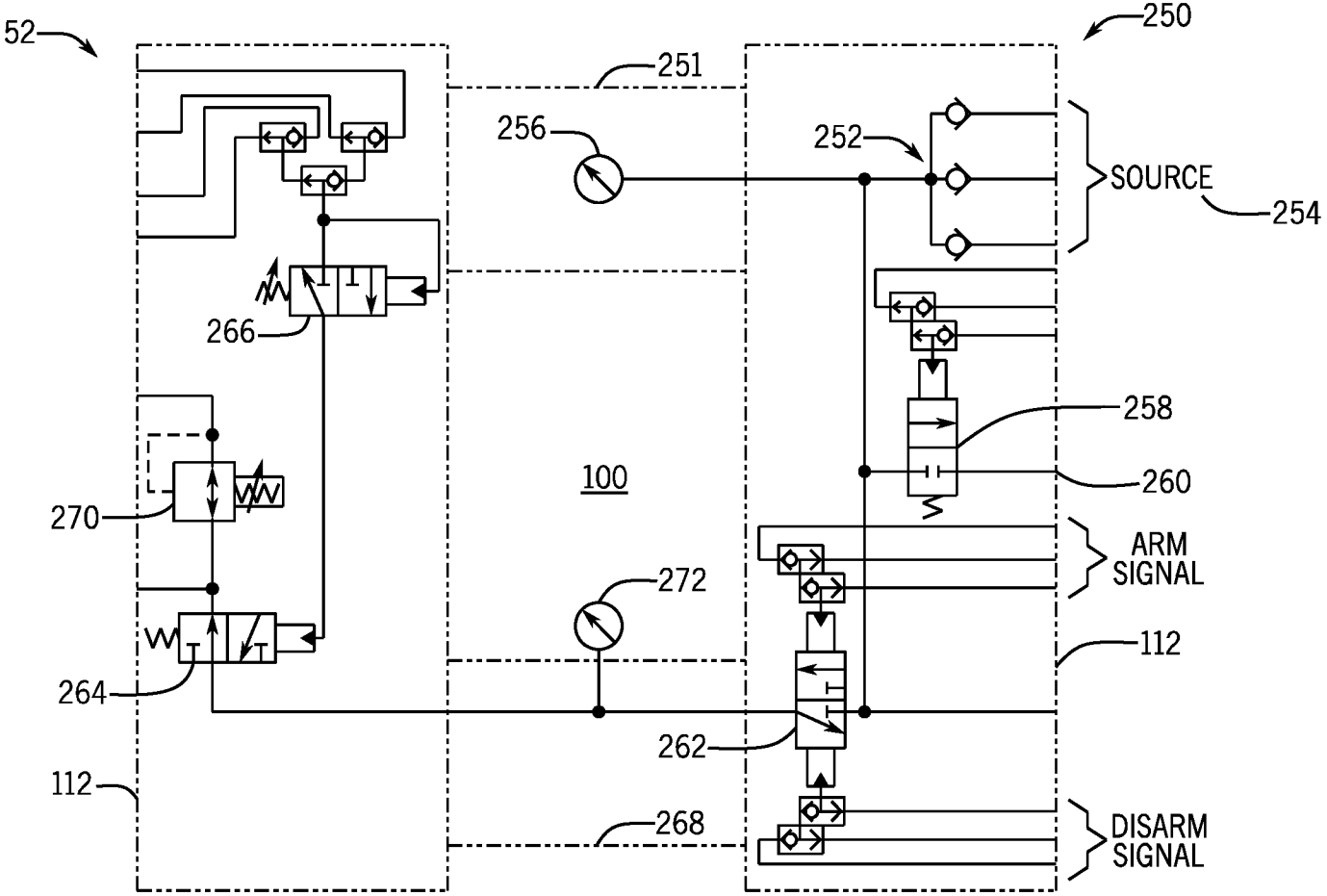
FIG. 9 is a schematic of an embodiment of a deadman/autoshear system (DMAS) module having a single ram block.
Figure 10:
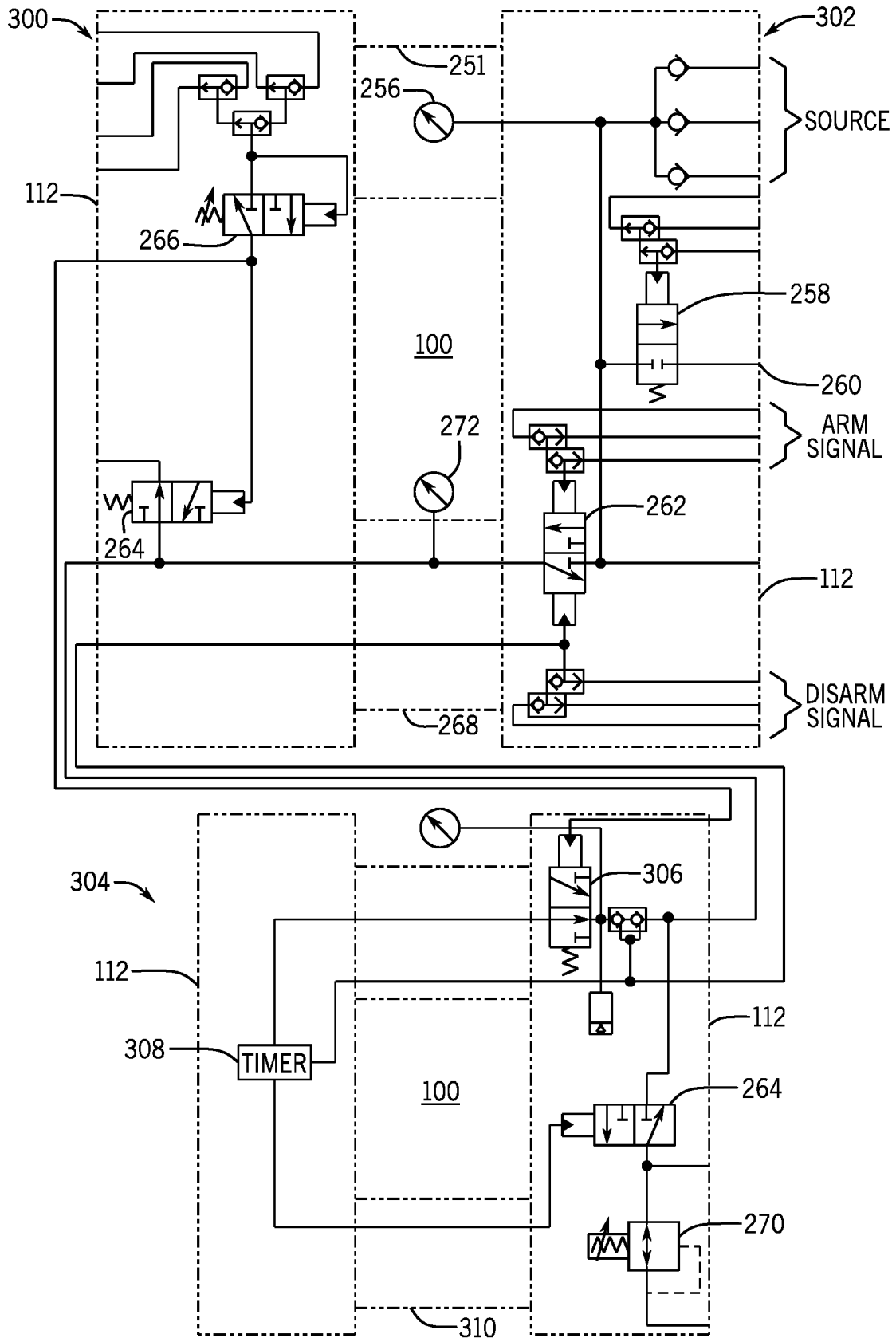
FIG. 10 is a schematic of an embodiment of a two-ram DMAS having first and second modules.
Figure 11:
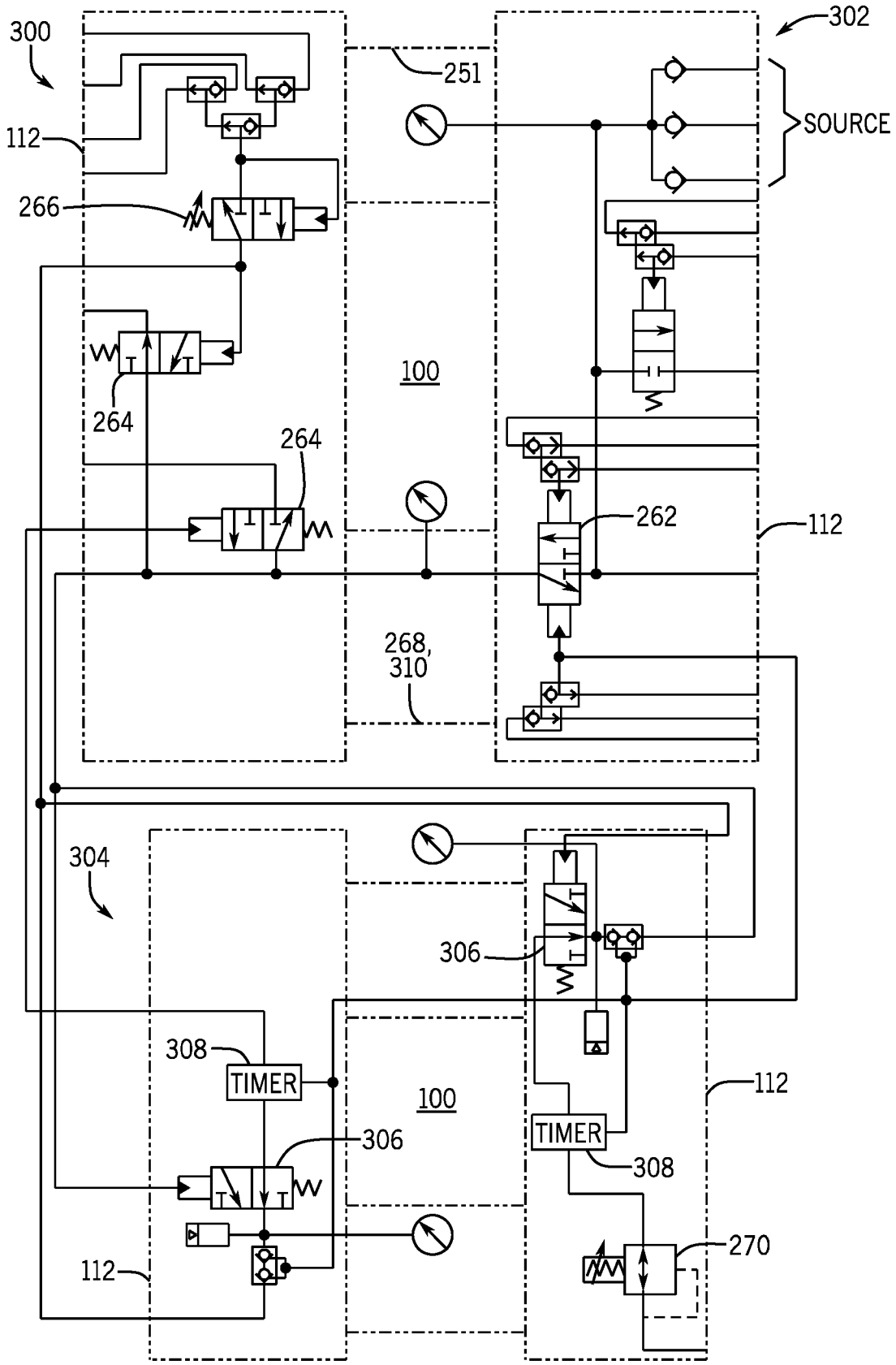
FIG. 11 is a schematic of an embodiment of the two-ram DMAS with dual timers.

The filter modules 150 shown in FIGS. 3-8 represent one of many possible functions that may be performed by the modules 52 of the BOP stack 46. It is also envisaged that one or more modules 52 may perform the functions of the deadman/autoshear systems (DMAS) of the BOP stack 46. The deadman system monitors the condition of the primary control system. During normal operations, the DMAS is activated (e.g., "armed") and prepared for actuation (e.g. "firing"). In the event of a loss of power, control signals, or hydraulic supply, the DMAS is actuated (e.g., "fired"). The autoshear system monitors the connection between the lower marine riser package (LMRP) and the lower BOP stack. If the DMAS is activated and the LMRP separates from the lower BOP stack when the system is armed, the DMAS actuates, or fires, cutting the wellbore 20 and sealing the well 12. FIGS. 9-11 illustrate various possible embodiments of a DMAS made of one or more modules 52. In general, when the DMAS is armed, an arm/disarm valve is opened, exposing stored hydraulic energy (e.g., from a hydraulic accumulator) to a trigger valve. If a triggering event occurs, the trigger valve opens, cutting the wellbore 20 and sealing the well 12 by actuating a plurality of shear rams. In some embodiments, the actuation of each of the shear rams may be temporally staggered by a timer.

FIG. 9 is a schematic of a DMAS module 250 having a single ram block. The various components of the DMAS module 250 are disposed about the chassis core 100 and may be divided into multiple sub-modules 112. The DMAS module 250 acts as a control node for charging and venting one or more hydraulic accumulators 251. A set of supply check valves 252 allow various sources 254 to charge the hydraulic accumulators via the hydraulic manifold 251. These sources 254 may be from the primary control system, the ROV 54, or some other source 254. An accumulator pressure gauge 256 monitors pressure in the hydraulic accumulator 251. If the pressure in the hydraulic accumulator is higher than desired, an accumulator dump valve 258 may be actuated (e.g., based on signals from the primary control system or the ROV 52) to vent hydraulic fluid (e.g., via a vent port 260) to reduce pressure in the accumulator 251.

An arm/disarm valve 262 may be actuated based on arm signals and disarm signals received from the primary control system or the ROV 52. When the arm/disarm valve is open (i.e., DMAS is armed), the hydraulic fluid is exposed to a trigger valve 264. During operation, one or more signals are monitored. When one of the monitored signals meets certain conditions (e.g., threshold exceeded, signal drops out, etc.), a quick dump valve 266 closes, in turn opening the trigger valve 264 and causing the ram 268 to close, shearing the borehole 20 and sealing the well 12. In some embodiments, a ram close/lock mechanism 270 may lock the ram 268. The module 250 may also include a DMAS arm indicator 272 (e.g., a sensor) to determine the position of the ram 268 arm.

FIG. 10 is a schematic of a two-ram DMAS 300 having first and second modules 302, 304. For a DMAS 300 with multiple rams, non-sealing (e.g., non-locking) rams are fired (e.g., actuated) first and then a locking ram is fired (e.g., actuated) on a delay. Accordingly, the first module 302 is much like the DMAS module 250 shown and described with regard to FIG. 9, except that the ram close/lock mechanism 270 is moved to the second module 304, because the ram 268 of the first module 302 is a non-locking ram. As with the single DMAS 250 of FIG. 9, for the DMAS 300, when the arm/disarm valve 262 of the first module 302 is armed, the entire DMAS 300 is armed (i.e., both rams are armed). When the one or more monitored signals meet the conditions discussed above (e.g., threshold exceeded, signal drops out, etc.), a signal is sent to the second module 304, opening a time trigger 306, which starts a timer 308. When the timer 308 expires, a trigger valve 264 for the second ram 310 is opened, closing the second ram 310. As previously discussed, the second ram is a locking ram, so the second module 304 includes the ram close/lock mechanism 270. It should be understood that these techniques may be used to build a DMAS 300 having any number of rams, where the number of modules is equal to the number of rams and the last ram is a locking ram, such that the module for the last ram includes the ram close/lock mechanism 270.

In some embodiments, it may be desirable to lock the locking ram 310 after a given period of time has passed after the locking ram 310 has been actuated. In such an embodiment, a second timer 308 may be used. FIG. 11 is a schematic of an embodiment of the two-ram DMAS 300 with dual timers 308. As shown, the second ram 310 and trigger valve 264 for the second ram 310 are shifted from the second module 304 to the first module 302 to make room for the second timer 308. When the trigger valve 264 for the second ram 310 opens to close the second ram 310, the second timer 308 is started. When the second time 308 expires, the ram close/lock mechanism 270 is actuated to lock the second ram block 310.

It should be understood that FIGS. 9-11 illustrated several different embodiments of a DMAS made of multiple submodules 112 distributed across one or more modules 52. It should be understood that the various submodules 112 may be replaced or built up on site (e.g., on the rig) according to the design of the specific BOP stack 46 design. As such, the number of rams, the type of rams, timers, etc. may be customized in each module 52 via the selection of submodules 112 according to the specific BOP stack 46 design. However, the illustrated embodiments are not intended to limit the claimed subject matter. As such, various other embodiments of the DMAS having function submodules, timing submodules, and accumulator control submodules 112 are envisaged.

Figure 12:
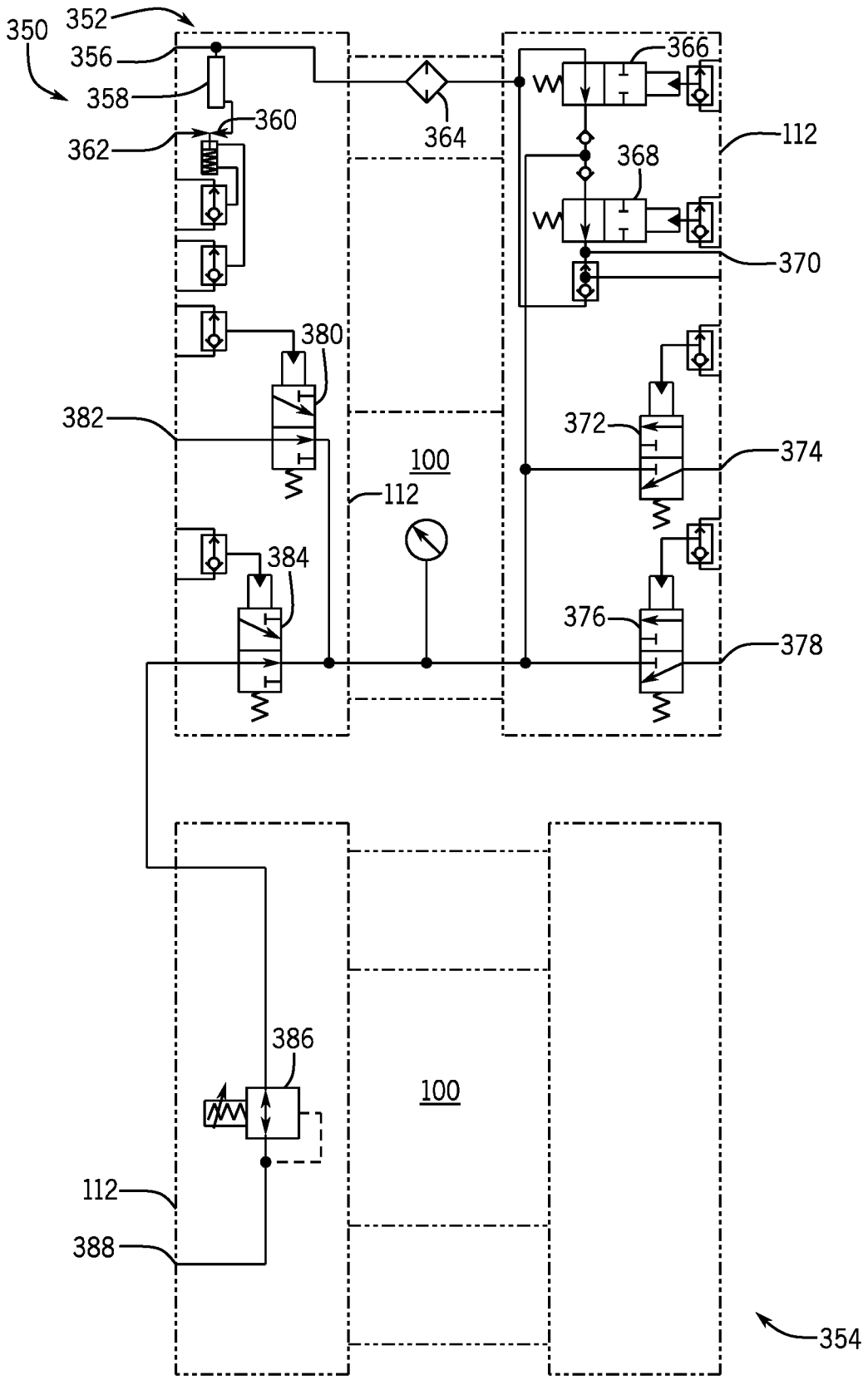
FIG. 12 is a schematic of an embodiment of an rigid conduit manifold (RCM) distributed over first and second modules.

It is also envisaged that one or more modules 52 may perform the functions of rigid conduit manifold (RCM) of the BOP stack 46. The RCM acts as a distribution node for hydraulic fluid sent from the rig 40 via rigid conduits that run parallel to the riser 38. The hydraulic fluid is supplied via two rigid conduits, one for each side of the control system (e.g., "blue" and "yellow"). Each conduit may have its own RCM, or the conduits may share an RCM. FIG. 12 is a schematic of an embodiment of an RCM 350 distributed over first and second modules 352, 354. In the illustrated embodiment, each conduit has its own RCM 350. In general, the RCM 350 receives hydraulic fluid from the rig 40, and can either block the flow path, stopping the flow of hydraulic fluid, or route the flow of hydraulic fluid along one of several possible flow paths. As shown, hydraulic fluid is received via the hydraulic fluid inlet 356. In some embodiments, the hydraulic fluid may pass through a trash trap 358, which catches debris flowing with the fluid. A flush valve 360 may control the flow of fluid to flush outlet 362 (e.g., to the ROV 54) to flush out the conduits.

The first module 352 of the RCM 350 may also include a filter 364 through which hydraulic fluid flows before proceeding to the various accumulators and associated hardware. As illustrated, the first module 352 includes a rigid conduit isolate valve 366 and a hotline isolate valve 368. The rigid conduit isolate valve 366 closes to stop fluid flow through the associated rigid conduit. The hotline isolate valve 368 to isolate supply from the hotline to the main system supply. The RCM 350 has an opposite conduit valve 372 that controls fluid flow to the opposite conduit (e.g., via the opposite conduit coupling 374) and an accumulator charge valve 376, which controls fluid flow to one or more accumulators via the outlet 378.

Returning to the submodule 112 with the trash trap 358 and the flush valve 360, the first module 352 of the RCM 350 has an unregulated supply valve 382 that provides an unregulated supply of fluid via the unregulated supply outlet 382. Alternatively, a regulated supply valve 384 provides a fluid supply to the second module 354 of the RCM 350, which includes a flow regulator 386. The regulated fluid flow is then provided via a regulated supply outlet 388. It should be understood, however, that the RCM 350 shown in FIG. 12 is just one possible embodiment of many envisaged embodiment. As previously discussed, it should be understood that DMAS/RCM systems may include one or more modules 52, each including one or more submodules 112 that can be selected and build up onsite according to the design of the specific BOP stack 46 design. For example, some of the valves of the first module 352 may be moved to the second module 354. Similarly, other embodiments of the RCM may include fewer components, additional components, or different configurations of components.

Figure 13:
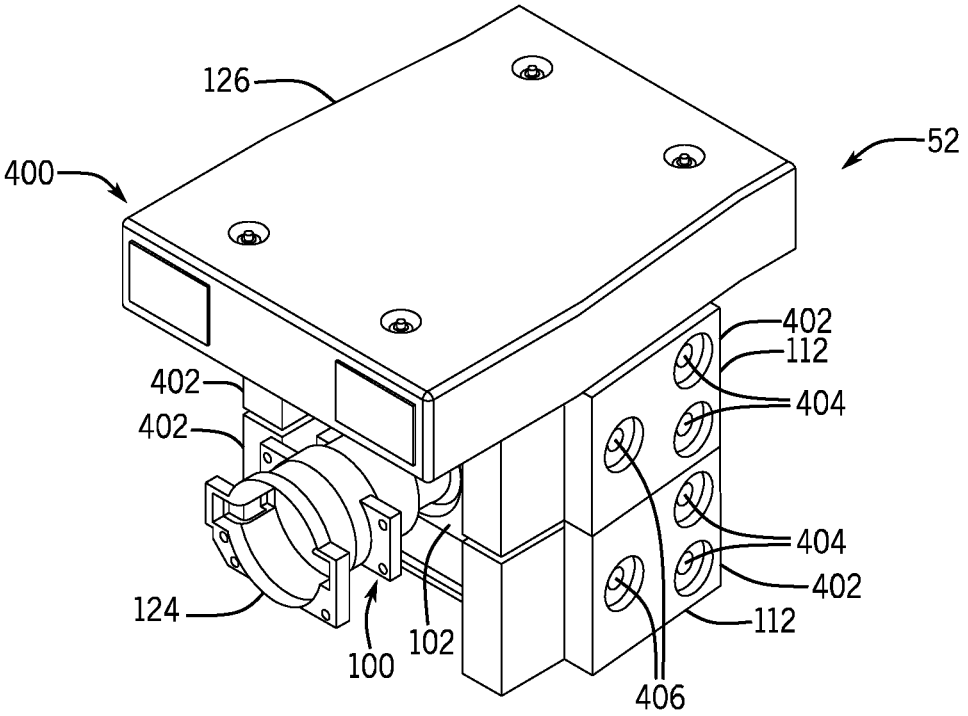
FIG. 13 is a perspective view of an embodiment of a shuttle valve module.
Figure 14:
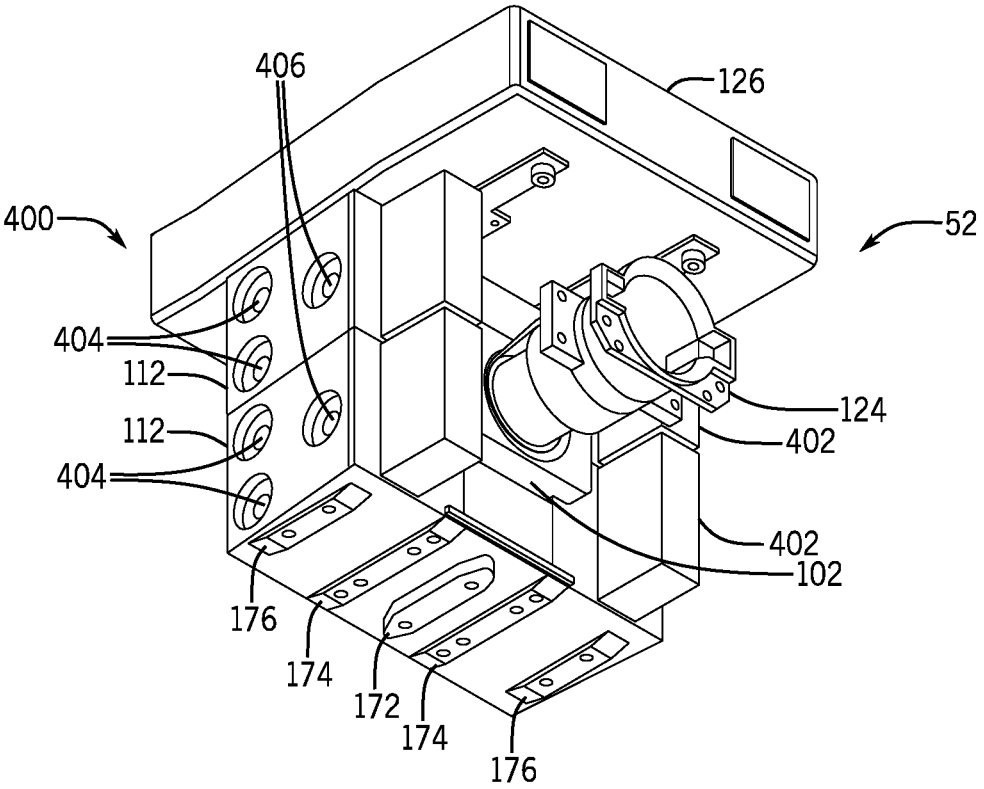
FIG. 14 is a perspective view an embodiment of the shuttle valve module of FIG. 13.
Figure 15:
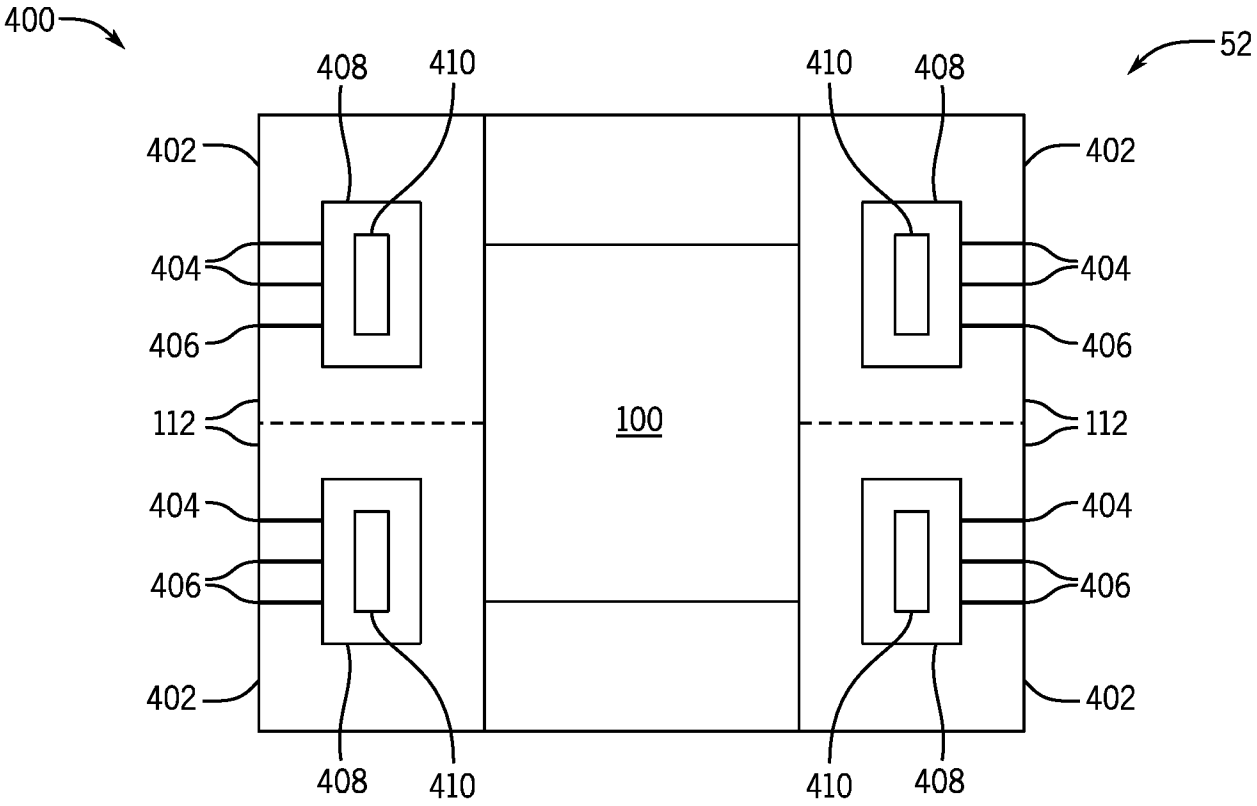
FIG. 15 is a schematic of an embodiment of the shuttle valve module of FIGS. 13 and 14.

Another function of the BOP stack 46 that can be modularized is shuttle valves. Shuttle valves receive two fluid flows via two inlets and, based on the position of the shuttle, allow one of the two fluid flows to flow through the valve to an outlet. Typically, unbiased shuttle valves allow the inlet fluid flow with the higher pressure to pass through the valve. In most cases, a BOP stack 46 has a single active side (e.g., blue or yellow). When a function is fired, the shuttle valve typically sees the signal coming from the fluid inlet associated with the active side, while the other fluid inlet is at approximately zero psig. FIGS. 13-15 illustrate a few envisaged embodiments of a shuttle valve module 400. FIG. 13 is a perspective view of an embodiment of the shuttle valve module 400. As with some of the previously described modules 52, the shuttle valve module 400 includes one or more submodules 112 coupled to the frame 102 of the chassis core 100. The shuttle valve module 400 interfaces with the ROV 54 via the torque tool bucket 124, which is coupled to the frame 102. The floatation device 126 is also coupled to the frame 102. In the instant embodiment, the shuttle valve module 400 includes four submodules 112, in this case shuttle valve submodules 402. Each shuttle valve submodule 402 includes two inlets 404 and one outlet 406. Inside each shuttle valve submodule 402, a shuttle shifts between first and second positions. When the shuttle is in the first position, the shuttle valve submodule 402 fluidly couples the first inlet 404 and the outlet 406, allowing fluid to flow into the first inlet 404, through the shuttle valve submodule 402, and out of the outlet 406. When the shuttle is in the second position, the shuttle valve submodule 402 fluidly couples the second inlet 404 and the outlet 406, allowing fluid to flow into the second inlet 404, through the shuttle valve submodule 402, and out of the outlet 406.

FIG. 14 is a perspective view an embodiment of the shuttle valve module 400 shown in FIG. 13. As illustrated, the module 400 includes a module guide 172, as well as primary and secondary runners 174, 176 to facilitate installation and removal of the module 400 in the BOP stack 46 by the ROV 54. FIG. 15 is a schematic of an embodiment of the shuttle valve module 400 shown in FIGS. 13 and 14. As illustrated, each of the four shuttle valve submodules 402 includes a shuttle valve 408 with a shuttle 410 that moves between first and second positions. When the shuttle 410 is in the first position, fluid flows from the first inlet 404 to the outlet 406. When the shuttle 410 is in the second position, fluid flows from the second inlet 404 to the outlet 406. Though the shuttle valve module 400 includes four shuttle valve submodules 402, each having a shuttle valve 408, it should be understood that the shuttle valve module 400 may include a different number of shuttle valve submodules 402, and that each shuttle valve module 402 may include more than one shuttle valve 408. As such, the shuttle valve module may be built up with various submodules 112 (e.g., shuttle valve submodules 402) according to the design of the specific BOP stack 46 design. As such, the embodiments of the shuttle valve module 400 shown in FIGS. 13-15 are merely examples of many possible embodiments of the shuttle valve module 400 and not intended to limit the scope of the claims.

Figure 16:
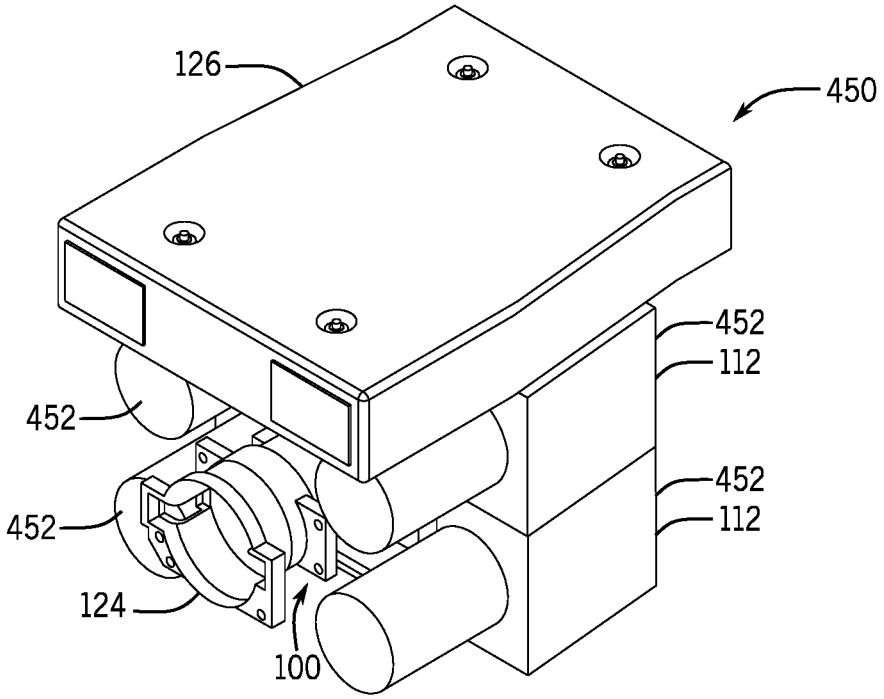
FIG. 16 is a perspective view of an embodiment of an electrical energy storage module.
Figure 17:
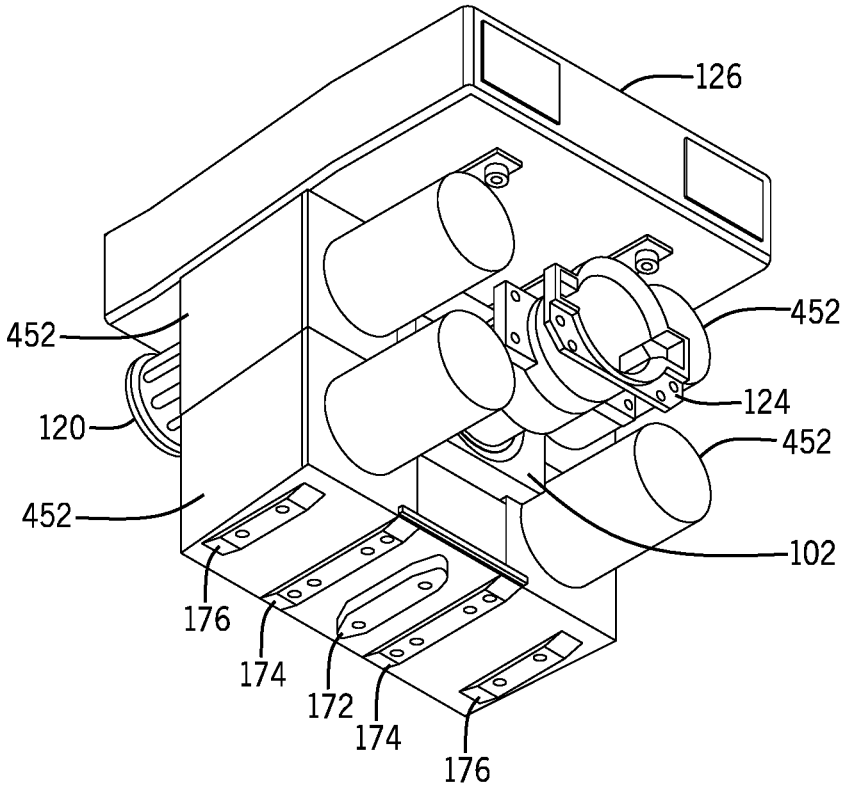
FIG. 17 is a perspective view an embodiment of the electrical energy storage module of FIG. 16.
Figure 18:
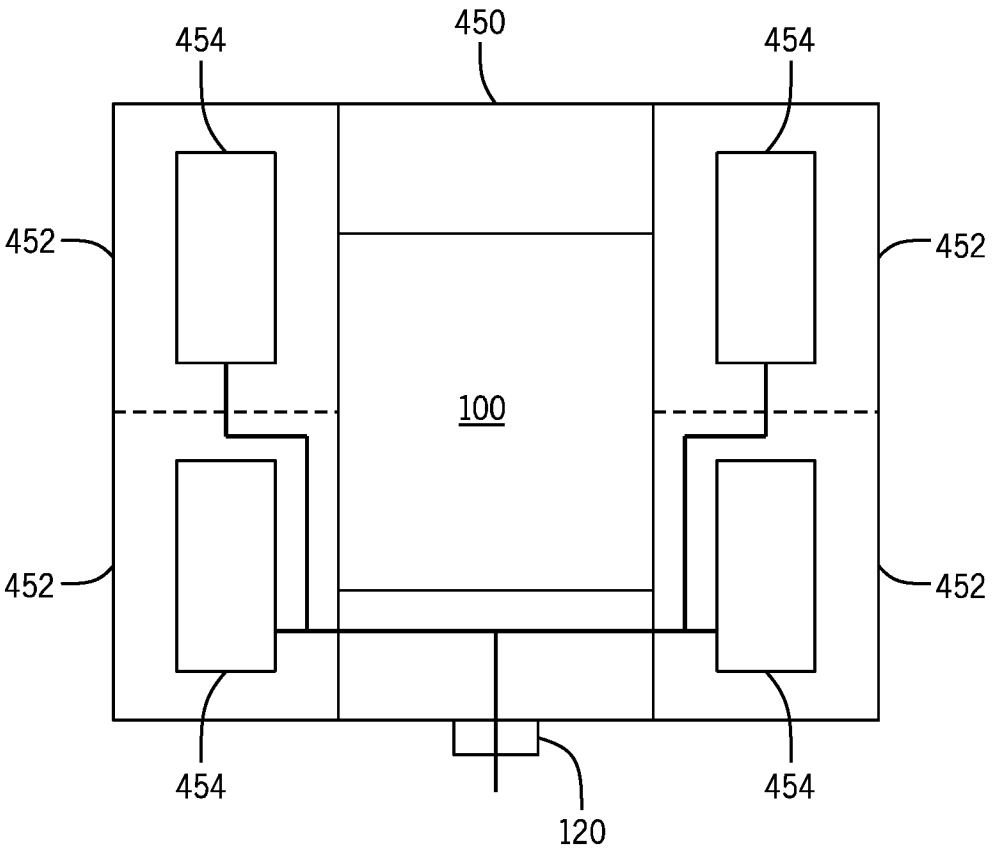
FIG. 18 is a schematic of an embodiment of the electrical energy storage module of FIGS. 16 and 17.

The energy storage functionality of the BOP stack 46 may also be modularized. FIGS. 16-18 illustrated a few envisaged embodiments of an electrical energy storage module 450. Without the disclosed embodiments, the various components of the BOP stack 46 draw power from an electrical energy storage device, such as a battery or a capacitor integrated within the BOP stack. To change the battery or capacitor, the well 12 is taken off-line, the entire BOP stack 46 may be disconnected and retrieved. The batteries and/or capacitors are then changed out. The BOP stack 46 is then returned to the sea floor 16, reinstalled, and drilling is resumed. Batteries and capacitors on the BOP stack 46 typically last a matter of weeks or months. Because changing the batteries and/or capacitors is such a significant undertaking, taking the well 12 off-line for as long as 10-15 days, electrical energy draw for each component is kept as low as possible. By modularizing the electrical energy storage function of the BOP stack 46, the batteries and/or capacitors of a BOP stack 46 can be retrieved and replaced by an ROV in a day or two rather than 10-15 days. FIG. 16 is a perspective view of the electrical energy storage module 450. As illustrated, a plurality of electrical energy storage submodules 452 are coupled to the frame 102 of the chassis core 100. As previously discussed, the energy storage module 450 may be customized by selecting various electrical energy storage submodules 452. In some embodiments, the energy storage module 450 may include multiple redundant batteries and/or multiple receptacles to allow installation of multiple batteries. The torque tool bucket 124 is coupled to the chassis core 100 and provides an interface for the ROV 54. The floatation device 126 helps to manage the buoyancy of the electrical energy storage module 450. Each of the electrical energy storage submodules 452 includes one or more batteries and/or one or more capacitors configured to store electrical energy. When the electrical energy storage module 450 is installed, various components of the BOP stack draw power from the batteries and/or capacitors. After the stored electrical energy is depleted, or after a set period of time, the electrical energy storage module 450 may be retrieved and replaced by an ROV with one or more "charged" electrical energy storage modules 450.

FIG. 17 is a perspective view an embodiment of the electrical energy storage module 450 shown in FIG. 16. As illustrated, the module 450 includes a module guide 172, as well as primary and secondary runners 174, 176 to facilitate installation and removal of the module 450 in the BOP stack 46 by the ROV 54. The electrical energy storage module 450 also includes one or more electrical connectors 120 for an interface between the electrical energy storage module 450 and the BOP stack 46. Accordingly, the electrical energy storage module 450 may provide electrical power for various components within the BOP stack 46 via the one or more electrical connectors 120.

FIG. 18 is a schematic of an embodiment of the electrical energy storage module 450 shown in FIGS. 16 and 17. As illustrated, each of the one or more electrical energy storage submodules 452 may include one or more batteries, capacitors, fuel cells, etc. 454 that store electrical energy. The various batteries and/or capacitors 454 may be electrically coupled, either directly or indirectly to one or more electrical connectors 120. When the electrical energy storage module 450 is installed in the BOP stack 46, the electrical connector 120 may interface with a complimentary electrical connector 120 on the BOP stack 46 to provide electrical energy to one or more components of the BOP stack 46. Because modularizing the electrical energy storage functions of the BOP stack 46 makes changing out the batteries and/or capacitors 454 much faster than previously possible, electrical energy draw of the components of the BOP stack may become a less important design factor.

Figure 19:
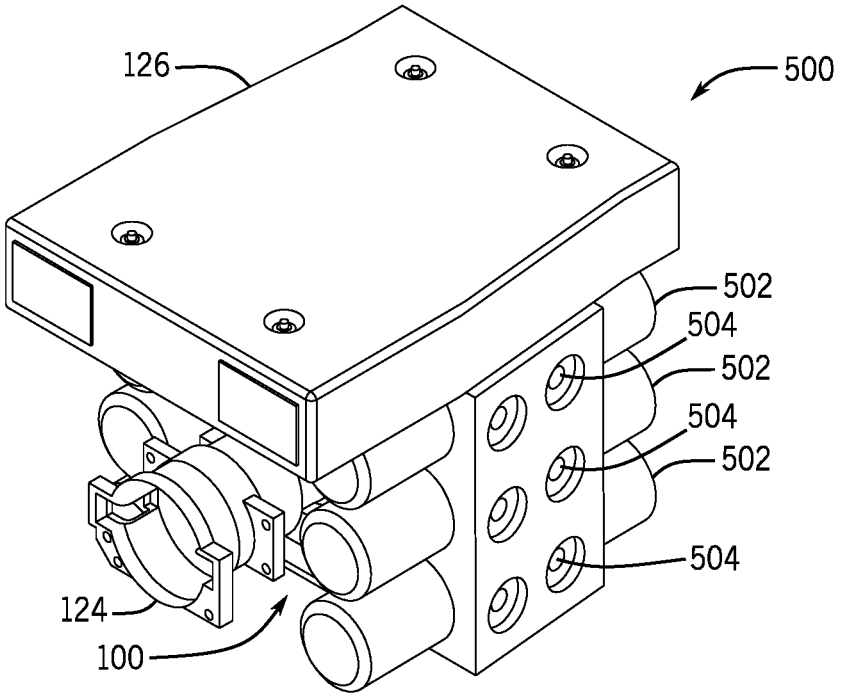
FIG. 19 is a perspective view of an embodiment of a hydraulic energy storage module.
Figure 20:
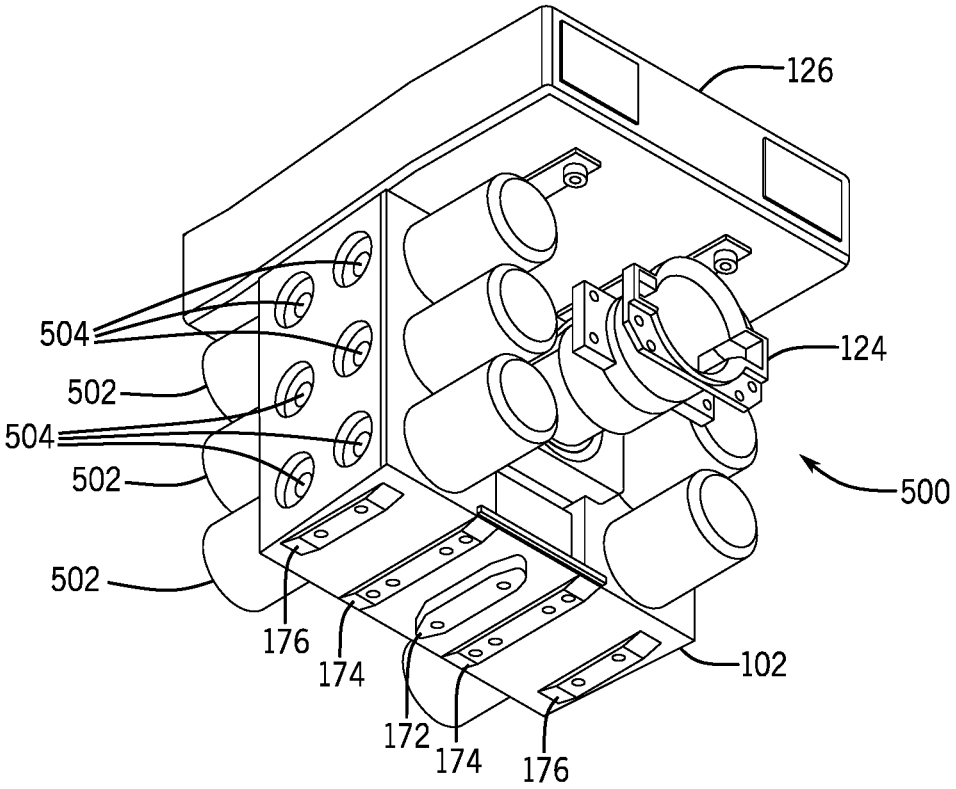
FIG. 20 is a perspective view an embodiment of the hydraulic energy storage module of FIG. 19.
Figure 21:
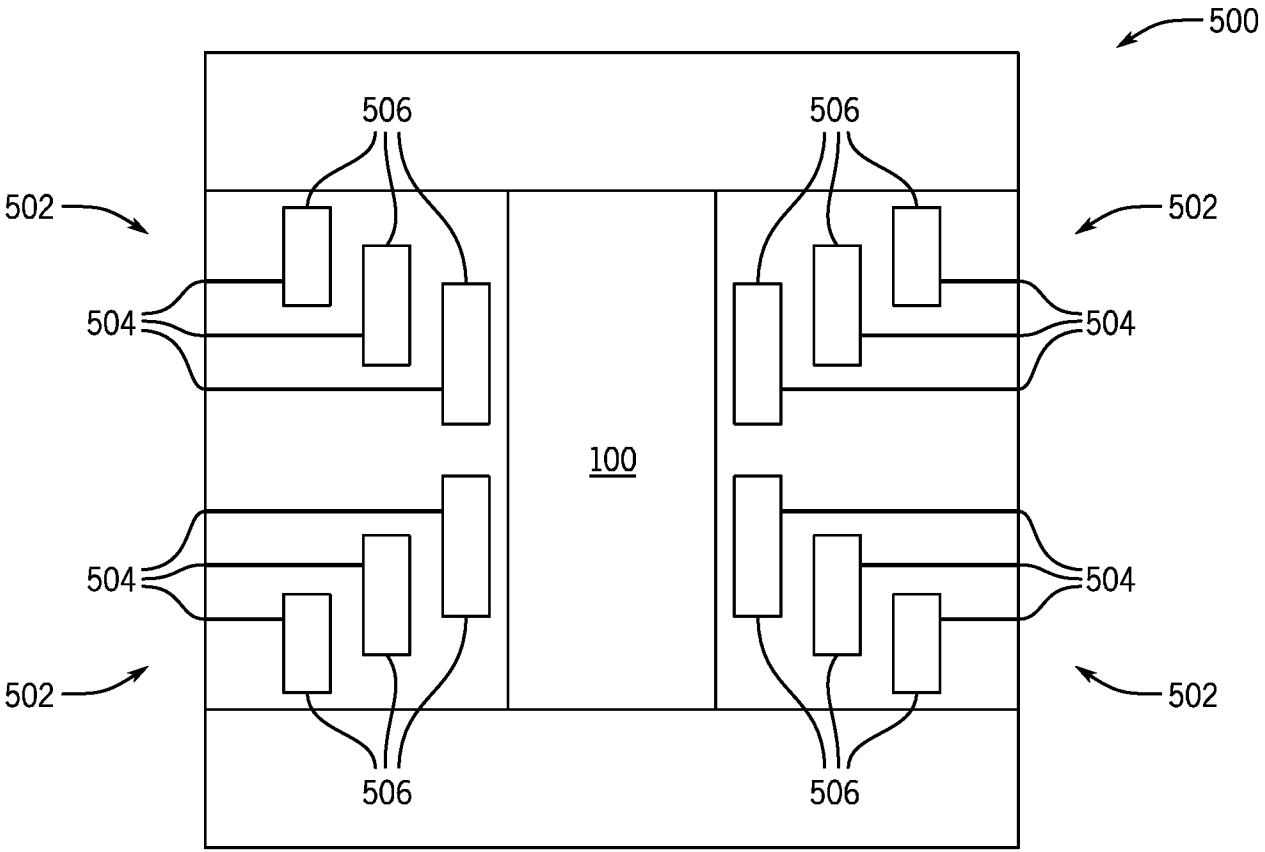
FIG. 21 is a schematic of an embodiment of the hydraulic energy storage module of FIGS. 19 and 20.

As with the electrical energy storage functionality of the BOP stack 46, the hydraulic energy storage functionality of the BOP stack 46 may also be modularized. FIGS. 19-21 illustrate several embodiments of a hydraulic energy storage module 500. As previously discussed, the BOP stack 46 may have many components (e.g., BOP rams, valves, various actuators, pumps, etc.) that are hydraulically actuated. As such, these components draw hydraulic energy from hydraulic energy storage devices, such as gas-over hydraulic accumulators, spring loaded hydraulic accumulators, intensifiers or de-boost devices. FIG. 19 is a perspective view of an embodiment of the hydraulic energy storage module 500. As illustrated, a plurality of hydraulic energy storage submodules 502 are coupled to the frame 102 of the chassis core 100. As with the other modules 52 discussed, the hydraulic energy storage module 500 may be customized by selecting the appropriate hydraulic energy storage submodules 502 to achieve the desired functionality when the BOP stack 46 is being designed. The hydraulic energy storage module 500 may then be built up using various hydraulic energy storage submodules 502 according to the design of the specific BOP stack 46 design. The torque tool bucket 124 is coupled to the chassis core 100 and provides an interface for the ROV 54. The floatation device 126 helps to manage the buoyancy of the hydraulic energy storage module 500. Each of the hydraulic energy storage submodules 502 includes one or more hydraulic accumulators, intensifiers or de-boost devices configured to store hydraulic energy and one or more hydraulic ports 504. When the hydraulic energy storage module 500 is installed, various components of the BOP stack draw hydraulic power from the accumulators, intensifiers or de-boost devices. After a set amount of the stored hydraulic energy us dissipated, or after a set period of time, the hydraulic energy storage module 500 may be retrieved and replaced by an ROV.

FIG. 20 is a perspective view an embodiment of the hydraulic energy storage module 500 shown in FIG. 19. As illustrated, the module 500 includes a module guide 172, as well as primary and secondary runners 174, 176 to facilitate installation and removal of the module 500 in the BOP stack 46 by the ROV 54. The hydraulic energy storage module 500 also includes one or more hydraulic ports 504 as an interface between the hydraulic energy storage module 500 and the BOP stack 46. Accordingly, the hydraulic energy storage module 500 may provide hydraulic power for various components within the BOP stack 46 via the one or more hydraulic ports 504.

FIG. 21 is a schematic of an embodiment of the hydraulic energy storage module 500 shown in FIGS. 19 and 20. As illustrated, each electrical energy storage submodule 502 includes one or more (e.g., three) chambers 506 that store hydraulic energy. The various chambers 506 may be fluidly coupled, either directly or indirectly to the hydraulic ports 504. When the hydraulic energy storage module 500 is installed in the BOP stack 46, the hydraulic ports 504 may interface with complimentary hydraulic connectors on the BOP stack 46 to provide hydraulic energy to one or more components of the BOP stack 46. Because modularizing the hydraulic energy storage functions of the BOP stack 46 makes changing out or charging the hydraulic energy storage devices (e.g., accumulators, intensifiers, de-boost devices, etc.) much faster than previously possible, hydraulic energy draw of the components of the BOP stack may become a less important design factor.

Figure 22:
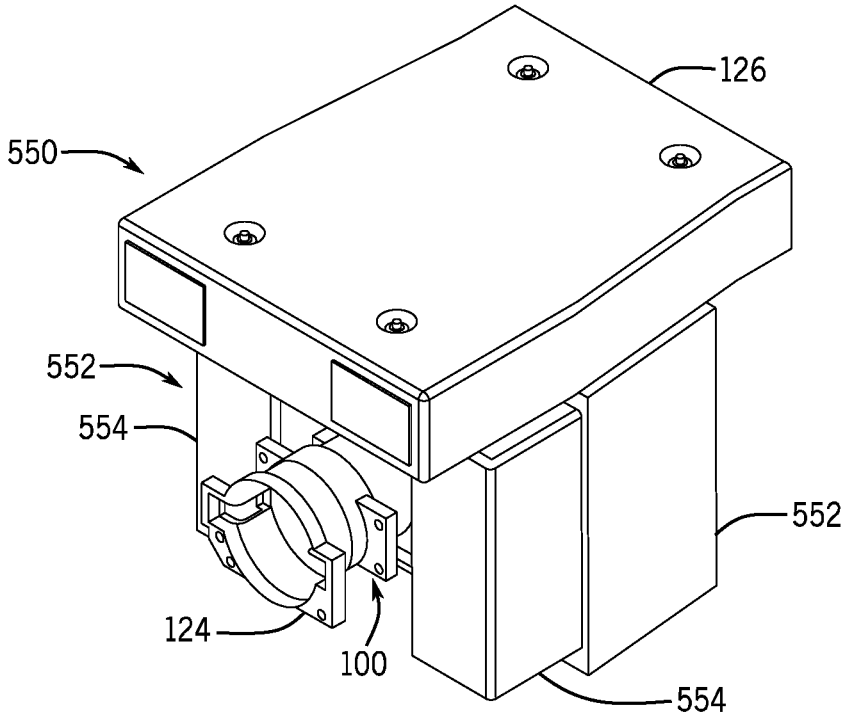
FIG. 22 is a perspective view of an embodiment of a subsea electronics module (SEM)
Figure 23:
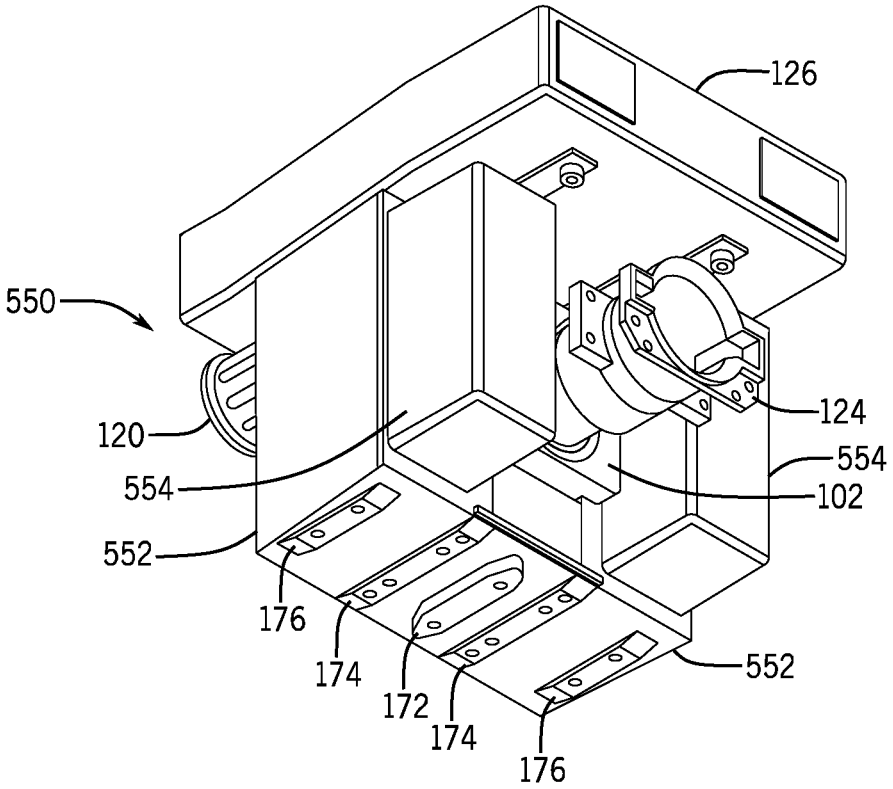
FIG. 23 is a perspective view an embodiment of the SEM of FIG. 22.
Figure 24:
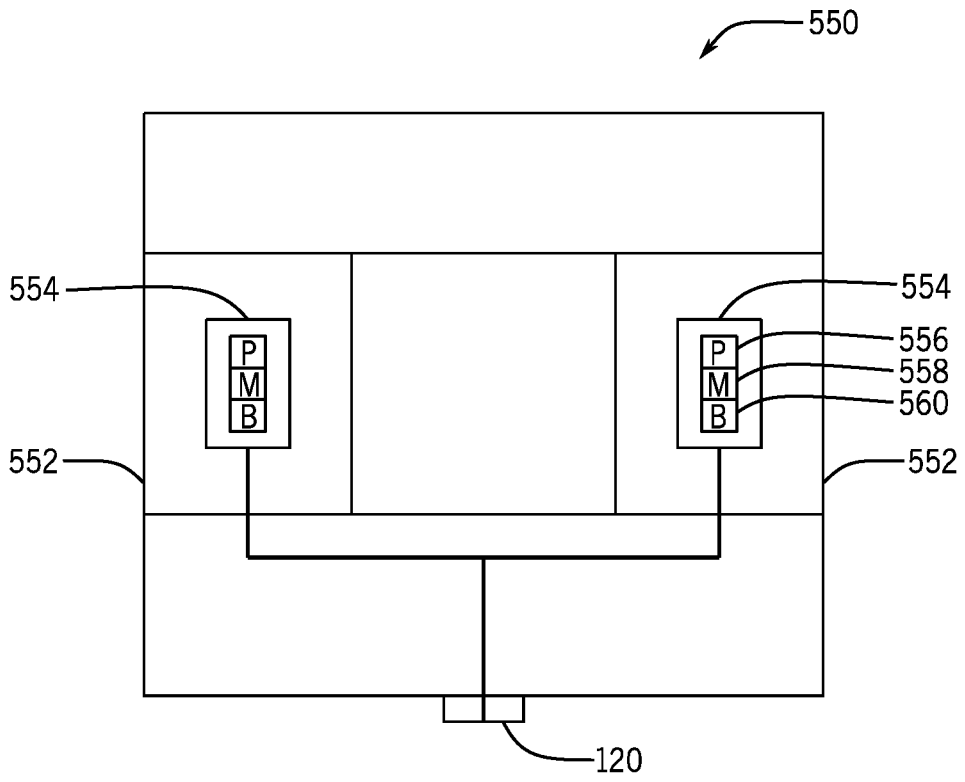
FIG. 24 is a schematic of an embodiment of the SEM of FIGS. 22 and 23.

Another possible envisaged module is a subsea electronics module (SEM), which acts as a sort of brain for the BOP stack 46 control system. FIGS. 22-24 illustrated several embodiments of a SEM 550. Without the disclosed embodiment, the SEM may be mounted in the MUX section of a subsea BOP control pod. However, if the SEM malfunctions, the entire LMRP or BOP stack 46 must be retrieved, taking the well 12 off-line for as long as one to two weeks. By modularizing the SEM 46, the may be retrieved or replaced with an ROV 54 in a day or two. FIG. 22 is a perspective view of an embodiment of the SEM 550. As illustrated, a plurality SEM submodules 552 are coupled to the frame 102 of the chassis core 100. The torque tool bucket 124 is coupled to the chassis core 100 and provides an interface for the ROV 54. The floatation device 126 helps to manage the buoyancy of the SEM 550. Each of the SEM submodules 552 includes one or more chambers that house various electrical control components at approximate 1 atmosphere of pressure. When the SEM 550 is installed, it supplies control signals to various components throughout the BOP stack 46.

FIG. 23 is a perspective view an embodiment of the SEM 550 shown in FIG. 22. As illustrated, the SEM 550 includes a module guide 172, as well as primary and secondary runners 174, 176 to facilitate installation and removal of the module 500 in the BOP stack 46 by the ROV 54. The SEM 550 also includes one or more electrical connectors 120 as an interface between the SEM 550 and the BOP stack 46. Accordingly, the SEM 550 may provide control signals for various components within the BOP stack 46 via the one or more electrical connectors 120.

FIG. 24 is a schematic of an embodiment of the SEM 550 shown in FIGS. 22 and 23. As illustrated, each SEM submodule 552 includes one or more chambers 554 that house various electrical components at approximately 1 atmosphere of pressure. For example, the various electrical components may include one or more processors 556 (e.g., microprocessors, circuit boards, programmable logic controllers, etc.), one or more memory components 558, one or more batteries or capacitors 560, or some combination thereof. The memory components 558 may store data (e.g., collected from sensors distributed throughout the BOP stack 46) and/or programs, algorithms, or routines to be run by the processors 556. The batteries 560 may be the primary power source for the SEM 550, or may act as a backup power source if the primary electrical power source of the BOP stack 46 fails. When the SEM 550 is installed in the BOP stack 46, the electrical connectors 120 may interface with a complimentary electrical connectors on the BOP stack 46 to provide control signals to one or more components of the BOP stack 46.

Figure 25:
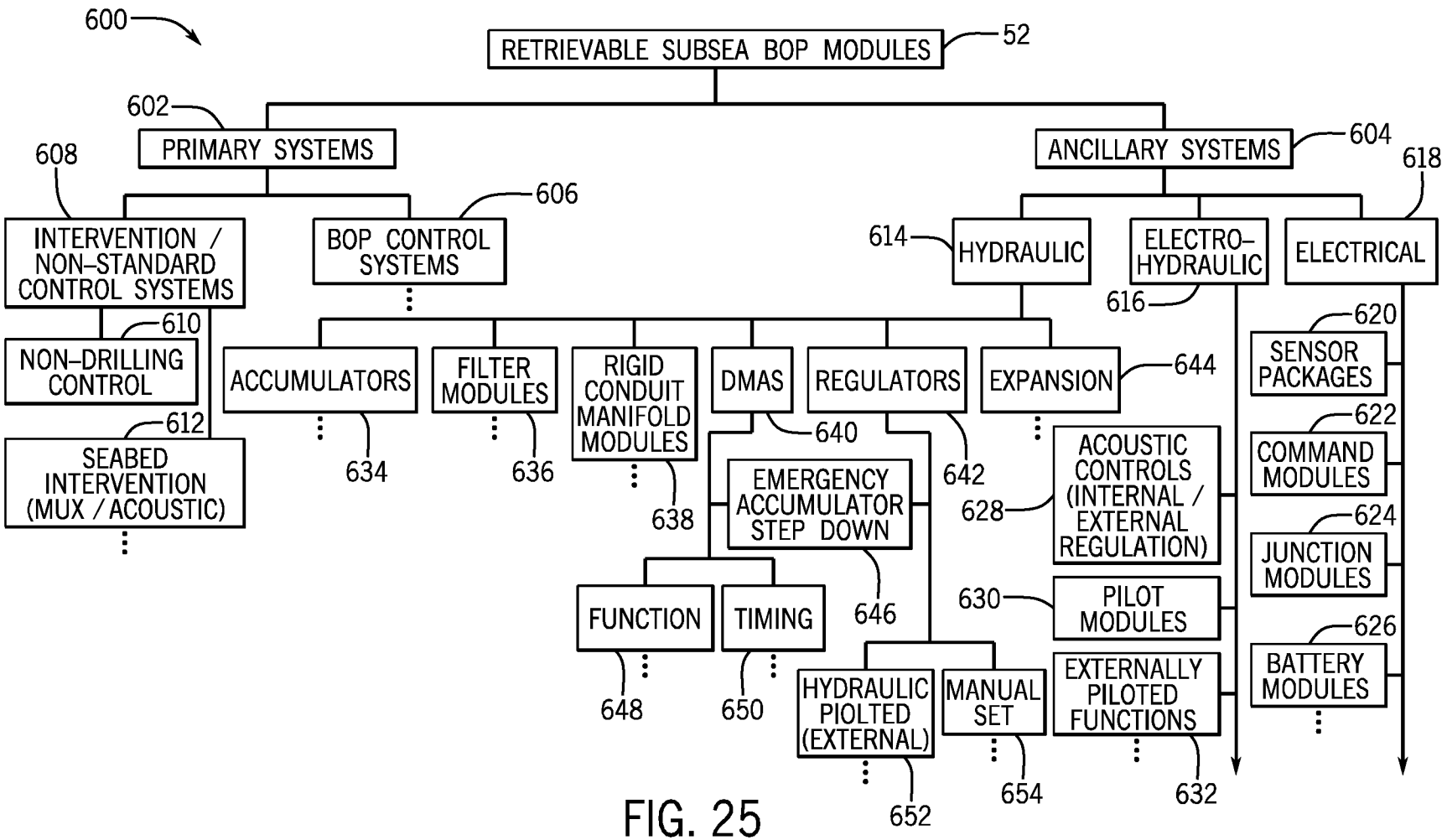
FIG. 25 is a family tree of various embodiments of retrievable subsea BOP modules.

Though FIGS. 3-24 illustrate a various possible embodiments for the modules 52, it should be understood that the disclosed embodiments are merely examples and that many other possible embodiments of the modules 52 are envisaged. Accordingly, the disclosed techniques may be used to modularize functions or components of the BOP stack 46, such that various components may be replaced by, or various functions performed by, one or more modules 52 that may be retrievable by an ROV 54. Further, as discussed with regard to the various module 52 embodiments, each module 52 may be customized to a specific BOP stack 46 design by selecting various submodules 112 to achieve the desired functionality. The submodules 112 may then be assembled to form a module 52 according to the design of the specific BOP stack 46 design. As such, each submodule 112 may be designed for specific setup, component, of set of components. In some embodiments, each module 52 or submodule 112 may include redundant processors, memory components, sources of energy, etc. FIG. 25 is a family tree of various embodiments of retrievable subsea BOP modules 52. As previously described, modules may be divided into primary systems modules 602 and ancillary systems modules 604.

The primary systems modules 602 may include, for example, BOP control system modules 606 and intervention/non-standard control system modules 608. The BOP control systems modules 606 may modularize primary control functions of the BOP stack 46 and may include, for example, the SEM 550 shown and described with regard to FIGS. 22-24. However, it should be understood that the SEM is one of many possible BOP control systems modules 606. The intervention/non-standard control systems modules 608 may include, for example, non-drilling control modules 610, seabed intervention (MUX/acoustic) modules 612, etc.

The ancillary system modules 604 may be subdivided into hydraulic modules 614, electro-hydraulic modules 616, and electrical modules 618. Electrical modules 618 may include, for example, sensor packages 620, command modules 622, junction modules 624, battery modules, etc. The electro-hydraulic modules 616 may include, for example, acoustic controls 628 (including internal and/or external regulation), pilot modules 630, externally piloted function modules 632, etc.

Hydraulic modules may be further subdivided into, for example, accumulator modules 634, filter modules 636, rigid conduit manifold modules 638, DMAS modules 640, regulator modules 642, and expansion modules 644. Emergency accumulator step down modules 646 may include or encompass DMAs modules 640 and regulator modules 642. DMAS modules 640 may further include, for example, DMAS function modules 648 and DMAS timing modules 650, etc. The regulator modules 642 may include, for example, hydraulic piloted (external) regulator modules 652, manually set regulator modules 654, etc.

It should be understood, however, that the various modules 52 shown in the family tree 600 of FIG. 25 do not constitute an exhaustive list of possible modules 52, but is instead merely an illustrative set of examples. As such, using the disclosed techniques, any component, system, or function of the BOP stack 46 may be modularized by distributing the associated components and/or systems across one or more ROV-retrievable modules 52.

Figure 26:
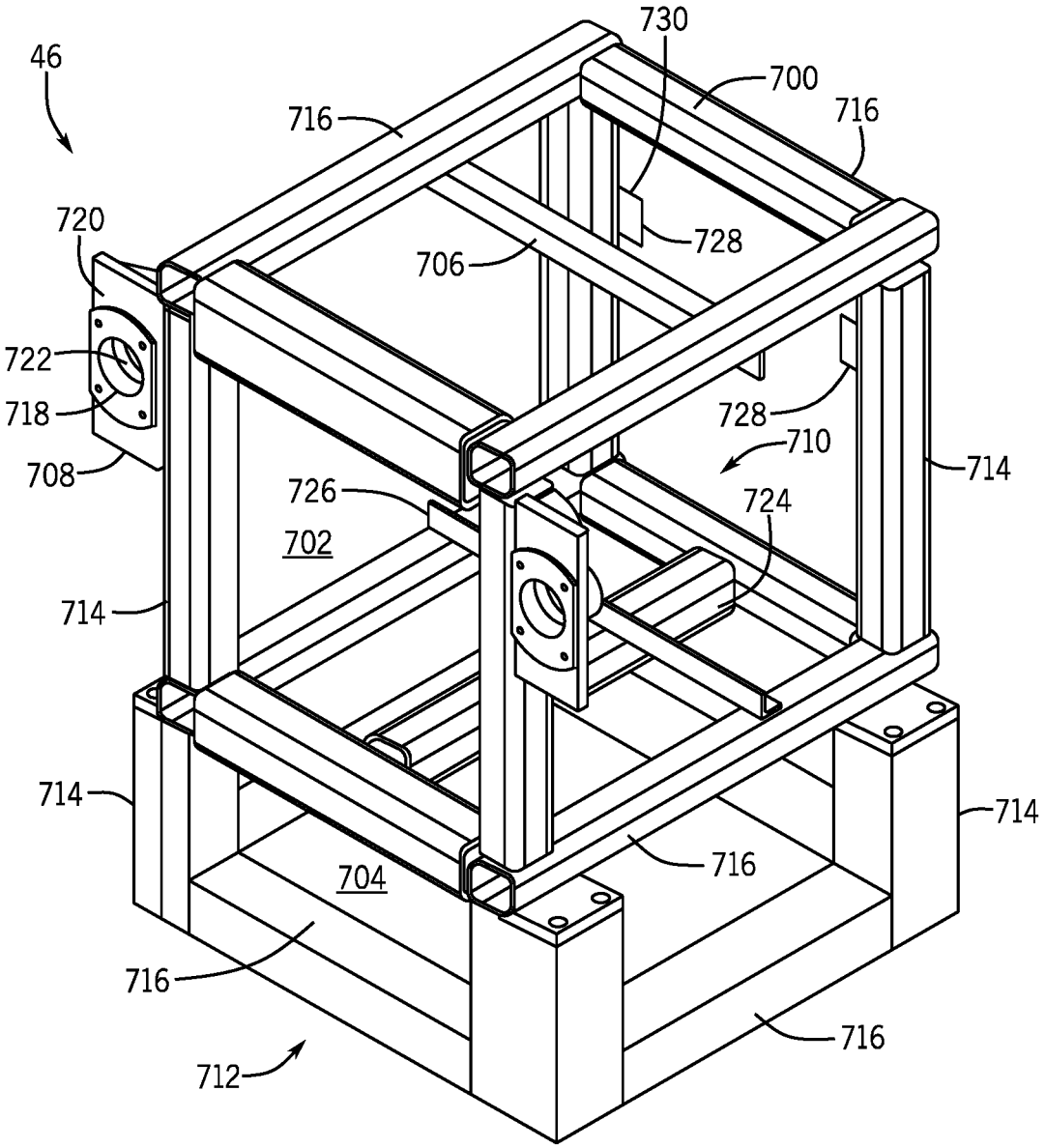
FIG. 26 is a perspective view of an embodiment of a portion of a blowout preventer (BOP) stack frame.

The ROV-retrievable modules 52 may interface with a frame of the BOP stack 46. FIG. 26 is a perspective view of an embodiment of a portion of the BOP stack frame 700. As shown, the frame 700 includes a module receptacle 702 configured to receive the module 14. The frame 700 may also include an exchange weight receptacle 704 configured to receive an exchange weight used to control the buoyancy of the ROV54 and its payload. The specifics of the exchange weight are described below with regard to FIGS. 29 and 30. In some embodiments, the frame 700 may include any number (e.g., 1, 2, 3, 4, 5, 6, 7, 8, 9, 10, or more), size, geometry, and/or configuration of receptacles 702, 704. The frame 700 includes docking hardware 706, mounting hardware 708, payload coupling hardware 710, and exchange weight coupling hardware 712 configured to facilitate insertion and removal of modules 52 and the exchange weight via the ROV 54. As illustrated, the frame 700 includes a plurality of interconnected beams or supports, which include vertical supports 714 and horizontal supports 716. Collectively, the supports 714, 716 of the frame 700 define the receptacles 702 and 704.

The docking hardware 706, mounting hardware 708, module coupling hardware 710, and exchange weight coupling hardware 712 are coupled to the frame 700. For example, the docking hardware 706 may include one or more docking joints or couplings 718 (e.g., first and second spaced couplings), which may include respective docking plates 720 and receptacles 722 (e.g., circular receptacles, indents, or passages). In some embodiments, the couplings 718 may include male and/or female couplings 718, which removably couple with docking hardware (e.g., docking joints or couplings) on the ROV 54. For example, the ROV 54 may include docking couplings (e.g., male joints, detents, or arms) that extend into and interlock with the receptacles 722 of the couplings 718. In certain embodiments, the docking couplings 718 include two circular receptacles 722 (e.g., indents) on either side of the frame 700, which may interface with complementary docking hardware (e.g., two detents) on the ROV 54 to secure the ROV 54 to the frame 700 while the module 52 and/or exchange weight are being deposited or retrieved. The mounting hardware 708 may include one or more guide rails 724 and module stops 726. The guide rails 724 extend lengthwise along the receptacles 702, 704 in a direction of insertion or removal of the module 52 or exchange weight, while the stops 726 may extend crosswise into the receptacles 702 and 704 to limit a depth of insertion. The module coupling hardware 710 and exchange weight coupling hardware 712 may be disposed in one or more portions of the receptacles 702 and 704, and may include one or more joints or couplings (e.g., male and/or female couplings). For example, the hardware 710 and 712 may include mating structures, such as male and female tracks or rails, male and female latch assemblies, male and female snap-fit structures, mating protrusions and recesses, mating hooks and receptacles, mating detents and indentions, magnetic couplings, or any combination thereof.

In certain embodiments, the frame 700 may include any number, size, geometry, and configuration of receptacles 702 and 704. For example, the frame 700 may include a plurality of uniform receptacles 702 and/or 704, a plurality of different receptacles 702 and/or 704, or a combination thereof. By further example, the receptacles 702 and/or 704 may be arranged vertically one over another, horizontally side by side, or distributed throughout the submerged system. In embodiments with equally sized receptacles 702 and 704, the frame 700 is configured to facilitate exchange of equally sized modules 52 and exchange weights with the ROV 54. In embodiments with differently sized receptacles 702 and 704, the frame 700 is configured to facilitate exchange of differently sized modules 52 and exchange weights with the ROV 54; however, the ROV 54 may exchange multiple smaller packages (e.g., modules 52 and/or exchange weights) with fewer (e.g., one) larger packages (e.g., modules 52 and/or exchange weights) in certain applications. In other words, the exchange of packages (e.g., modules 52 and/or exchange weights) between the ROV 54 and the frame 700 may be a ratio of greater than, less than, or equal to 1:1, 1:2, 1:3, 1:4, 1:5, 1:10, or vice versa.

Furthermore, the frame 700 may be configured to support a plurality of exchange weights in respective receptacles 704, such that the ROV 54 may be configured to selectively retrieve one or more of the exchange weights to obtain a desired buoyancy suitable for a return trip to the surface 42. For example, each of the exchange weights may have an equal or different weight, which may be used alone or in combination with one another to define a desired weight when retrieved by the ROV 54. Similarly, each of the exchange weights may have an equal or different buoyancy, which may be used alone or in combination with one another to define a desired buoyancy when retrieved by the ROV 54. In certain embodiments, the exchange weights may include a solid, liquid, or gas material configured to define a desired weight or buoyancy.

In some embodiments, the frame 700 may also support components 728 that interface with the module once deposited in the module receptacle 702. For example, these components 728 may have fluid, hydraulic, electrical, pneumatic, or other connectors that interface with the module 52. Accordingly, the frame 700 may include mounting hardware 730 for mounting these components 728, which may remain coupled to the frame 700 as the module 52 is deposited and retrieved. Such mounting hardware 730 may include cross-members, brackets, etc.

It should be understood, however that the frame 700 shown in FIG. 26 is merely one possible embodiment and that other configurations are also envisaged. For example, the frame 700 may have a different shape than the frame 700 shown. Further, the frame 700 may not completely enclose the module receptacle 702 and/or the exchange weight receptacle 704. The module receptacle 702 and the exchange weight receptacle 704 may be in different positions relative to one another than shown in FIG. 26. Further, the docking hardware 708 may include a different number of locations (e.g., 1, 3, 4, 5, 6, 7, 8, 9, 10, or more locations), which may be positioned differently than is shown in FIG. 26. Additionally, the docking hardware 708 may have a different geometry and interface with the corresponding docking hardware on the ROV 54 in a different way than is shown in FIG. 26.

Figure 27:
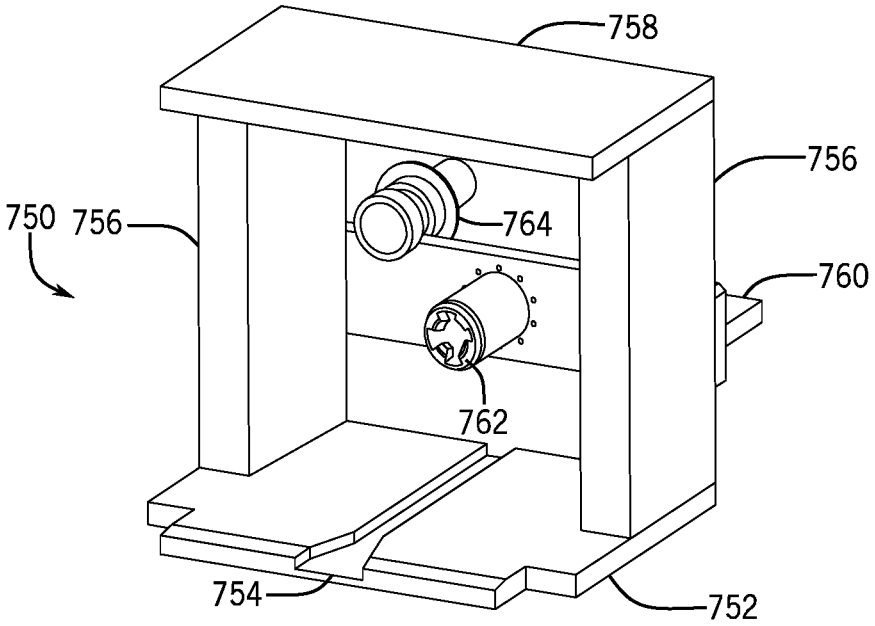
FIG. 27 is a perspective view of an embodiment of an electrical receiver.
Figure 28:
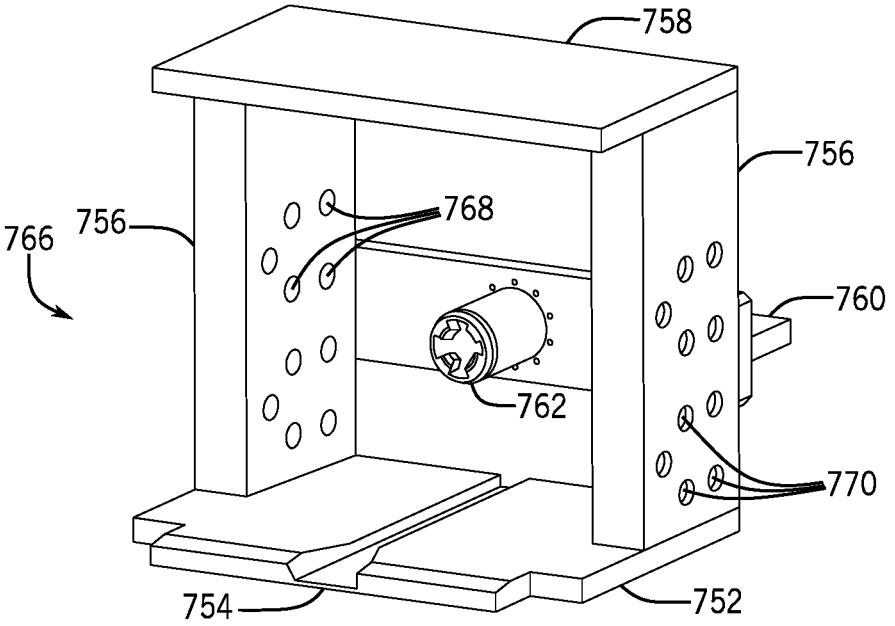
FIG. 28 is a perspective view of an embodiment of a hydraulic receiver.

In some embodiments, the frames may be equipped with electrical and/or hydraulic receivers to facilitate electrical of hydraulic connections with modules 52. The electrical and/or hydraulic receivers may be installed or retrieved by an ROV 54. FIGS. 27 and 28 illustrate embodiments of electrical and hydraulic receivers. FIG. 27 is a perspective view of an electrical receiver 750. The electrical receiver may be disposed within the module receptacle 702 of a BOP stack frame 700 and act as an interface between the BOP stack 46 and the module 52. The electrical receiver 750 includes a baseplate 752. As shown, the base plate 752 may include a tapered groove 754, which may interface with the module guide 172 of a module 52 to help facilitate proper installation of the module 52. The electrical receiver includes two side panels 756 extending upward from the base plate 752. Though not shown in FIG. 27, in some embodiments, the side panels 756 may be equipped with fluid, hydraulic, pneumatic, or electrical connections. A top panel 758 extends between the side panels 756 across the top of an installed module. The electrical receiver 750 also includes a back panel 762, which couples to the frame 700. The back panel 760 includes a coupling 762, which may couple to the latch of the module 52. In some embodiments, the coupling 762 may only be a mechanical coupling. In other embodiments, the coupling 762 may also include electrical, fluid, pneumatic, hydraulic couplings, or some combination thereof. In the illustrated embodiment, the back panel 760 includes a separate electrical coupling 764. However, in some embodiments, the electrical coupling 764 may be incorporated into the coupling 762.

FIG. 28 is a perspective view of a hydraulic receiver 766. The hydraulic receiver 766 may be disposed within the module receptacle 702 of a BOP stack frame 700 and act as an interface between the BOP stack 46 and the module 52. As with the electrical receiver 750 of FIG. 27, the hydraulic receiver 766 includes a baseplate 752 with tapered groove 754, two side panels 756 extending upward from the base plate 752, the top panel 758, and the back panel 760. As illustrated, the side panels 756 include internal hydraulic ports 768 and external hydraulic ports 770, which may fluidly couple the hydraulic receiver 766 to an adjacent receiver 766 or module 52. As with the electrical receiver 750, the back panel 760 includes a coupling 762, which may couple to the latch of the module 52. In some embodiments, the coupling 762 may only be a mechanical coupling. In other embodiments, the coupling 762 may also include electrical, fluid, pneumatic, hydraulic couplings, or some combination thereof.

Figure 29:
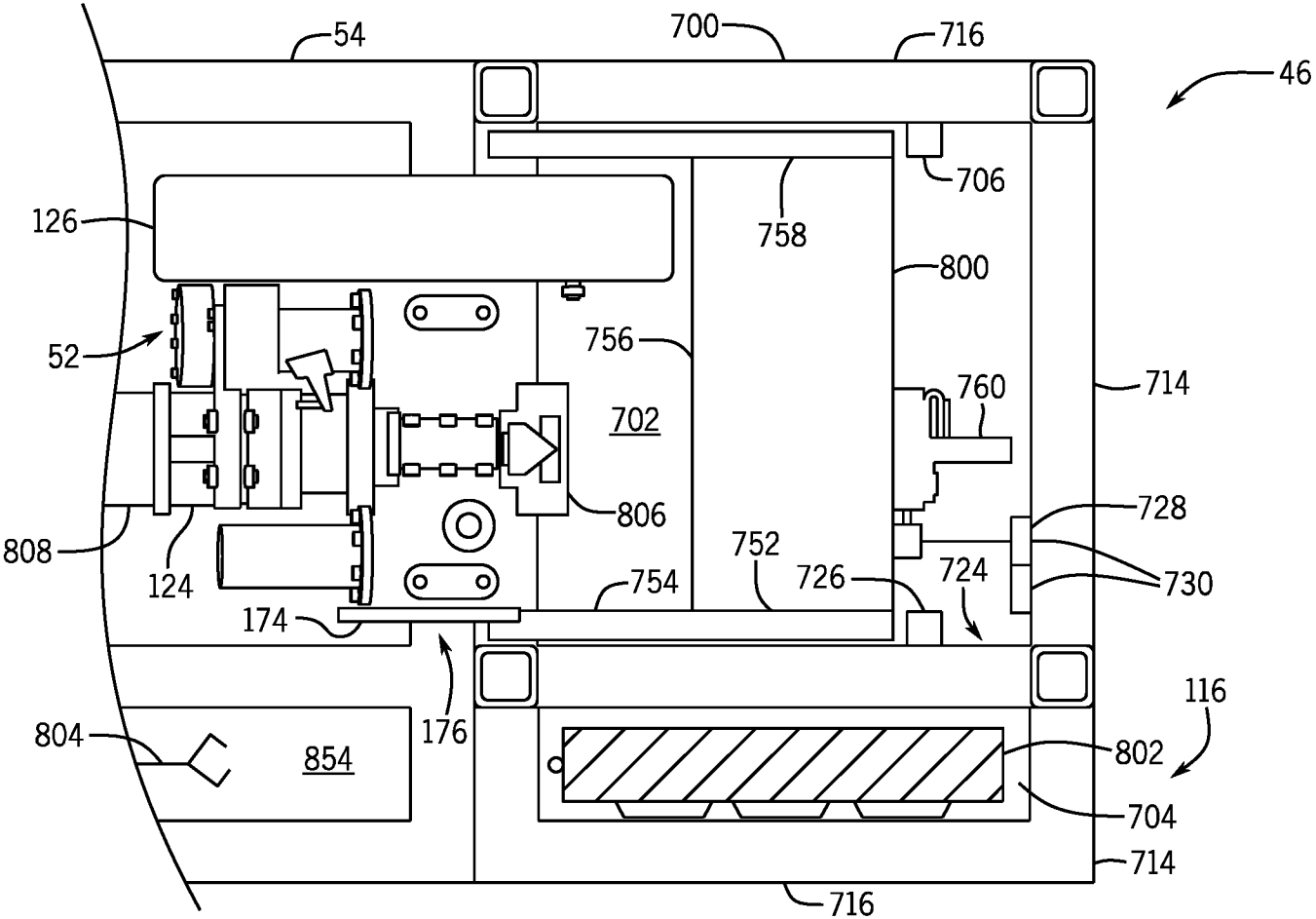
FIG. 29 is a side, section view of a remotely operated underwater vehicle (ROV) depositing the module in a module receptacle of the BOP stack frame.

FIG. 29 is a side, section view of the ROV 54 depositing a module 52 in the module receptacle 702 of the BOP stack frame 700. As shown, the ROV 54 has docked with the frame 700 (e.g., via docking hardware 720) and is in the process of depositing the module 52 in the module receptacle 702 of the frame 700. As shown, the frame 700, which is part of the BOP stack 46, includes a receiver 800, which is coupled to the frame 700 via component mounting hardware 706. The receiver 800 may include fluid, hydraulic, pneumatic, electrical, and/or other connectors that interface with complementary connectors on the module 52. In the illustrated embodiment, the ROV 54 retrieves an exchange weight 802 (e.g., via an arm 804) from the exchange weight receptacle 704 after the module 52 has been deposited within the module receptacle 702. As will be described in more detail below, the exchange weight 802 may have a similar mass or buoyancy as the module 52 such that the ROV 54 can return to the rig 40 or intermediate docking station 58 in a controlled fashion after undocking from the frame 700. However, in other embodiments, the exchange weight 802 may be retrieved before the module 52 is deposited, or while the module 52 is being deposited.

As illustrated, the module 52 includes a latch 806, which interfaces with the coupling 762 of the receiver 800 to secure the module 52 within the module receptacle 702 of the frame 700. The latch 806 may be actuated by a torque tool 808 of the ROV 54 (e.g., via the torque tool bucket 124). As described with regard to FIGS. 27 and 28, the base plate 752 of the may include the tapered groove 754 through which the module guide 172 slides as the module 52 is inserted and removed. Further, the primary runners 174 of the module may provide a low-friction interface between the module 52 and the receiver 800, allowing the module 52 to slide along the base plate 752 of the receiver 800

Figure 30:
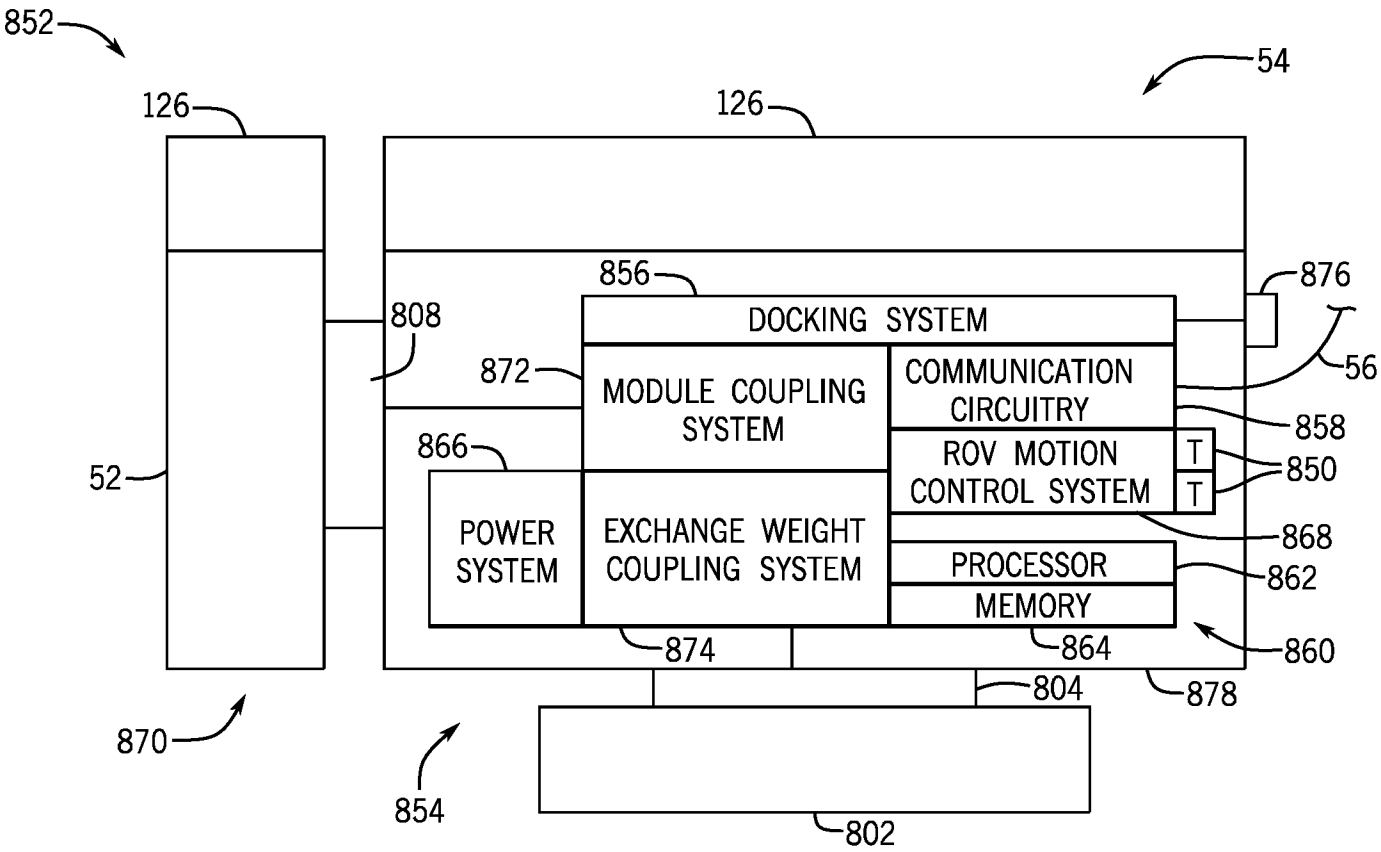
FIG. 30 is a schematic of an embodiment of the ROV.

FIG. 30 is a schematic of an embodiment of the ROV 54. As shown, the ROV 54 may include one or more thrusters 850, which provide thrust to control the location and motion of the ROV 54. The thrusters 850 may be variable (i.e., the direction of thrust for each thruster 850 is variable) or fixed (i.e., the direction of thrust for each thruster 850 is fixed), such that the thrusters may be used in concert to move the ROV 54 laterally within the body of water 18, and/or to control a depth of the ROV 54 within the body of water 18. Accordingly, the ROV 54 and its payload (e.g., module 52 or exchange weight 802) need not be perfectly neutrally buoyant to adjust the depth of the ROV 54. That is, as long as the combined mass or weight of the ROV 54 and payload is within a threshold value (e.g., 1,000 lbs) of the neutrally buoyant mass, the thrusters 850 may be used control the depth of the ROV 54 within the body of water 18. In other embodiments, the threshold may be 100 lbs, 200 lbs, 300 lbs, 400 lbs, 500 lbs, 600 lbs, 700 lbs, 800 lbs, 900 lbs, 1000 lbs, 1100 lbs, 1200 lbs, 1300 lbs, 1400 lbs, 1500 lbs, 1600 lbs, 1700 lbs, 1800 lbs, 1900 lbs, 2000 lbs, 2100 lbs, 2200 lbs, 2300 lbs, 2400 lbs, 2500 lbs, or some other value. In some instances, the mass of the module 52 or exchange weight 802 may far exceed the threshold value. As will be understood, the ROV 54 may be loaded with the module 52 or exchange weight 802 such that the combined mass of the ROV 54 and the module 52 or exchange weight 802 ("package mass") is within the threshold value of the neutrally buoyant mass. However, once the ROV 54 deposits the module 52 at the desired location (e.g., the module 52 is deposited in the module receptacle 702 of the BOP stack 46), because the mass of the payload is zero or has been reduced, the package mass may no longer be within the threshold value of the neutrally buoyant mass. Accordingly, the thrust provided by the thrusters 850 may be insufficient in controlling the depth of the ROV 54 as it returns back to the surface 42. Similarly, if the ROV 54 is sent to retrieve a module 52, the package mass may be within the threshold value of the neutrally buoyant mass on the way down (e.g., no module 52), but once the ROV 54 retrieves the module 52 at the BOP stack, the package mass may far exceed the neutrally buoyant mass, beyond a threshold value. In such an instance, the thrusters 850 would be unable to provide enough thrust to return the ROV 54 to the surface 42. To address this challenge, exchange weights 802 and floatation devices 126 (e.g., volumes of syntactic foam) may be used individually or in combination to maintain the package mass within the threshold value of the neutrally buoyant mass, or to maintain the package buoyancy within a threshold value of neutrally buoyant.

For example, in the illustrated embodiment, both the ROV 54 and the module 52 may be outfitted with one or more floatation devices 126. The floatation devices 126 may include volumes (e.g., blocks) of foam, or other devices that increase the buoyancy of the ROV 54 and/or the module 52. For example, in some embodiments, the floatation devices 126 may include composite materials synthesized by filling a metal, polymer, or ceramic matrix with hollow spheres called microballoons or cenospheres or non-hollowspheres, otherwise known as syntactic foam. Though the described embodiments utilize blocks (e.g., closed volumes, enclosed volumes, walled volumes, etc.) of syntactic foam as the floatation device 126, it should be understood that the disclosed techniques may be utilized with any device that increases buoyancy. The ROV 54 and the module 52 each may be outfitted with one or more floatation devices 126, such that the ROV 54 and the module 52 are individually within a threshold mass or buoyancy of neutral buoyancy, and such that combined ROV 54 and module 52 are close enough to neutrally buoyant that the thrusters 850 may be used to control the depth of the ROV 54 when carrying the module 52. However, when the ROV 54 deposits the module 52, the floatation devices 126 coupled to the module 52 are also deposited, such that the ROV 54 is close enough to neutrally buoyant that the thrusters 850 may be used to control the depth of the ROV 54 without the module 52. In the illustrated embodiment, the floatation devices 126 are disposed at or near the top of the ROV 54 and the module 52, such that the floatation devices 126 do not cause the ROV 54 or the payloads 14 to roll. By making each component in the package 852 (ROV 54, module 52, etc.)

within threshold values of neutrally buoyant, the various components may be coupled to one another and decoupled from one another without reaching a buoyancy that renders the thrusters 850 unable to control the depth of the ROV 54.

In some embodiments, the ROV 54 may also use an exchange weight 802 technique instead of, or in addition to, using floatation devices 126. For example, the ROV 54 may be equipped with an exchange weight receptacle 854. The exchange weight 802 may have a similar mass and/or buoyancy as the module 52. Accordingly, to deposit a module 52, the module 52 is loaded on the ROV 54 and the ROV 54 dives to the BOP stack 46. The ROV 54 then docks to the BOP stack frame using a docking system 50, which may include docking hardware 858. The module 52 is then deposited in the equipment receptacle 702 and an exchange weight 802 is retrieved from the exchange weight receptacle 704 of the BOP stack 46 and stored in the exchange weight receptacle 854 of the ROV 54. Though the illustrated embodiments include a single exchange weight 802 and corresponding exchange weight receptacles 854, 704, it should be understood that embodiments having one or more exchange weights 802 and corresponding receptacles 854, 704 (e.g., 1, 2, 3, 4, 5, 6, 7, 8, 9, 10, or more) are also envisaged. Further, such embodiments may include exchange weights 802 and receptacles 854, 704 of different weights, sizes, etc. The docking system 50 then decouples the ROV 54 from the BOP stack 46 and the ROV 54 returns to the surface 42. Because the exchange weight 802 has a mass and/or buoyancy substantially equal or similar to that of the module 52, the buoyancy of the total package 852 does not substantially change when the module 52 is exchanged for the exchange weight 802. Thus, the thrusters 850 are capable of returning the ROV 54 to the surface 42.

Similarly, to retrieve a module 52, the ROV 54 is equipped at the rig 40 or the intermediate docking station 58 with an exchange weight 802. The ROV 54 dives to the location of the module 52 to be retrieved (e.g., the BOP stack 46 or the intermediate docking station). The ROV 54 then docks to the frame 700 using the docking system 856. The module 52 is then retrieved from the 702 and the exchange weight 802 is deposited in the exchange weight receptacle 704 of the frame 700. The docking system 50 then decouples the ROV 54 from the frame 700 and the ROV 54 returns to the surface 42 with the module 52. Because the exchange weight 802 has a mass and/or buoyancy substantially equal or similar to that of the module 52, the buoyancy of the total package does not substantially change when the payload is retrieved and the exchange weight 802 deposited, thus the thrusters 850 are capable of returning the ROV 54 to the surface 42.

As previously described, the ROV 54 may receive signals (e.g., power, communication, control signals, etc.) via the umbilical cord 56. The umbilical cord 56 may be in communication with communication circuitry 858, which may provide the signals to an ROV control system 860. For example, the control system 860 may include a processor 862 and a memory component 864. The memory component 864 may store data, such as computer programs, code, received or collected data, etc. The processor 862 may run programs or code stored on the memory component 864. In some instances, the processor 862 may analyze data stored on the memory component 864. The control system 860 may control the various other components of the ROV 54.

The ROV 54 includes a power system 866. As previously described, the ROV 54 may receive power via the umbilical cord 56. In such embodiments, the communication circuitry 858 may route a power signal to the power system 866, which may provide power to the various components within the ROV 54. In some embodiments, the power system 866 may include a battery, capacitor, and/or some other energy storage device.

The ROV 54 also includes a propulsion system or motion control system 868, which may include the thrusters 850, and/or one or more other propelling devices. The thrusters 850 and or the motion control system 868 may include, for example, one or more generators, motors, hydraulic pumps, hydraulic motors, hydraulic cylinder, drive components, propellers, compressed gas/air/fluid reservoirs and outlets, etc. The motion control system 868 may control the direction and/or thrust provided by the one or more propelling devices 850 to control the position of the ROV 54. By maintaining buoyancy within a threshold value of neutral buoyancy, the size, thrust, power, etc. of the thrusters 850 may be reduced, enabling a less powerful motion control system 868 to handle larger loads than previously possible.

As previously discussed, the ROV 54 may couple to a module 52. Accordingly, the ROV 54 may include module coupling hardware 808 (e.g., the torque tool, receptacles, grabbing arms, clamps, snap-fit couplings, etc.) that acts as an interface between the ROV 54 and the module 52. In some embodiments, the module coupling hardware 808 may include male (e.g., torque tool 808) and female (torque tool bucket 124) components mounted on the ROV 54 and the module 52 that couple to one another. In other embodiments, the module coupling hardware 808 may not have corresponding hardware on the module 52. The module 52 may be received in a module receptacle 870 of the ROV 54. In some embodiments, the ROV 54 may include multiple module receptacles 870, of the same or different sizes, to accommodate multiple modules 14. In some embodiments, the receptacle 870 may not completely enclose the module 52. For example, the ROV 54 may couple to the module 52 via the torque tool 808 without pulling the module 52 into an enclosed receptacle (i.e., the torque tool may just grab the module 52). The torque tool 808 may be under the control of a module coupling system 872, which controls when and how the ROV 54 couples to the module 52.

Similarly, in embodiments in which the exchange weight 802 is used to control buoyancy of the ROV 54, the ROV 54 may include exchange weight coupling hardware 804 (e.g., brackets, gripping arms, trolleys, tracks, ratcheting systems, wenches, clamps, snapfit couplings, etc.) controlled by an exchange weight coupling system 874. As with the module coupling hardware 808, the exchange weight coupling hardware 804 may include male and female components mounted on the ROV 54 and the exchange weight 802 that couple to one another. In other embodiments, the exchange weight coupling hardware 804 may not have corresponding hardware on the exchange weight 802. As shown in FIG. 29, the exchange weight 802 may be received in one or more receptacles 854 of the ROV 54. In embodiments with multiple exchange weights 802 and receptacles 854, the receptacles 854 may be of the same or different sizes to allow a customization of the one or more exchange weights 802. As with the module receptacle 870, in some embodiments, the exchange weight receptacle 854 may not completely enclose the exchange weight 802. For example, the ROV 54 may couple to the exchange weight 802 via the exchange weight coupling hardware 804 without pulling the exchange weight 802 into an enclosed receptacle (i.e., the exchange weight coupling hardware 804 may just grab the exchange weight 802). The exchange weight coupling hardware 804 may be under the control of the exchange weight coupling system 874, which controls when and how the ROV 54 couples to the exchange weight 802. The exchange weight 802 may include a one or more solid blocks of material (e.g., lead, steel, etc.), or a container that may be selectively filled with a liquid or granular material to achieve a desired mass.

In embodiments in which the ROV 54 docks to the frame 700, the ROV 54 may be outfitted with the docking system 856, which may include docking hardware 876 (e.g., brackets, gripping arms, trolleys, tracks, ratcheting systems, wenches, clamps, snapfit couplings, etc.). In such an embodiment, the motion control system 868 may be used to position the ROV 54, at which point the docking hardware 876, under the control of the docking system 856, engages with a structure (e.g., frame 700) to secure the ROV 54. Once docked, the ROV 54 may retrieve or deposit the module 52, the exchange weight 802, or other objects. While the ROV 54 is docked, the buoyancy of the package 852 (e.g., ROV 54, module 52, exchange weight 802, etc.) may exceed the buoyancy window of the motion control system 868 (i.e., the buoyancy range in which the motion control system 868 is capable of controlling the ROV 54 within a body of water 18), because the ROV 54 relies on the frame 700, or other structure to remain stationary.

As previously discussed, in some embodiments, the ROV 54, the module 52, or both, may include floatation devices 126 (e.g., blocks of syntactic foam) for increasing the buoyancy of the ROV 54 and/or the module 52. As previously discussed, if the buoyancy of the package 852 is within a threshold value of neutrally buoyant, the motion control system 868 can control the depth of the ROV 54. However, if the buoyancy of the package 852 is beyond a threshold value above neutrally buoyant, the ROV 54 may float to the surface 42 in an uncontrolled manner. Correspondingly, if the buoyancy of the package 852 is beyond a threshold value below neutrally buoyant, the ROV 54 may sink to the sea floor 16. Accordingly, the ROV 54 and the module 52 may each be outfitted with floatation devices 126 such that the ROV 54 and the module 52 are each individually within the threshold value of neutrally buoyant, and the package 852 is also within the threshold value of neutrally buoyant when the ROV 54 and the module 52 are coupled to one another. In such a configuration, the ROV 54 and module 52 may couple to one another and decouple from one another without exceeding the threshold value from neutral buoyancy.

The ROV 54 may include or be attached to a frame 878 (e.g., skid). The module coupling hardware 808, the exchange weight coupling hardware 804, and the docking hardware 876 may be coupled to the frame 878 and provide an interface between the ROV 54 and other components (e.g., module 52, exchange weight 802, BOP stack 46, frame 700, intermediate docking station 58, etc.). Specific embodiments of the frame 878 are discussed in more detail below.

Figure 31:
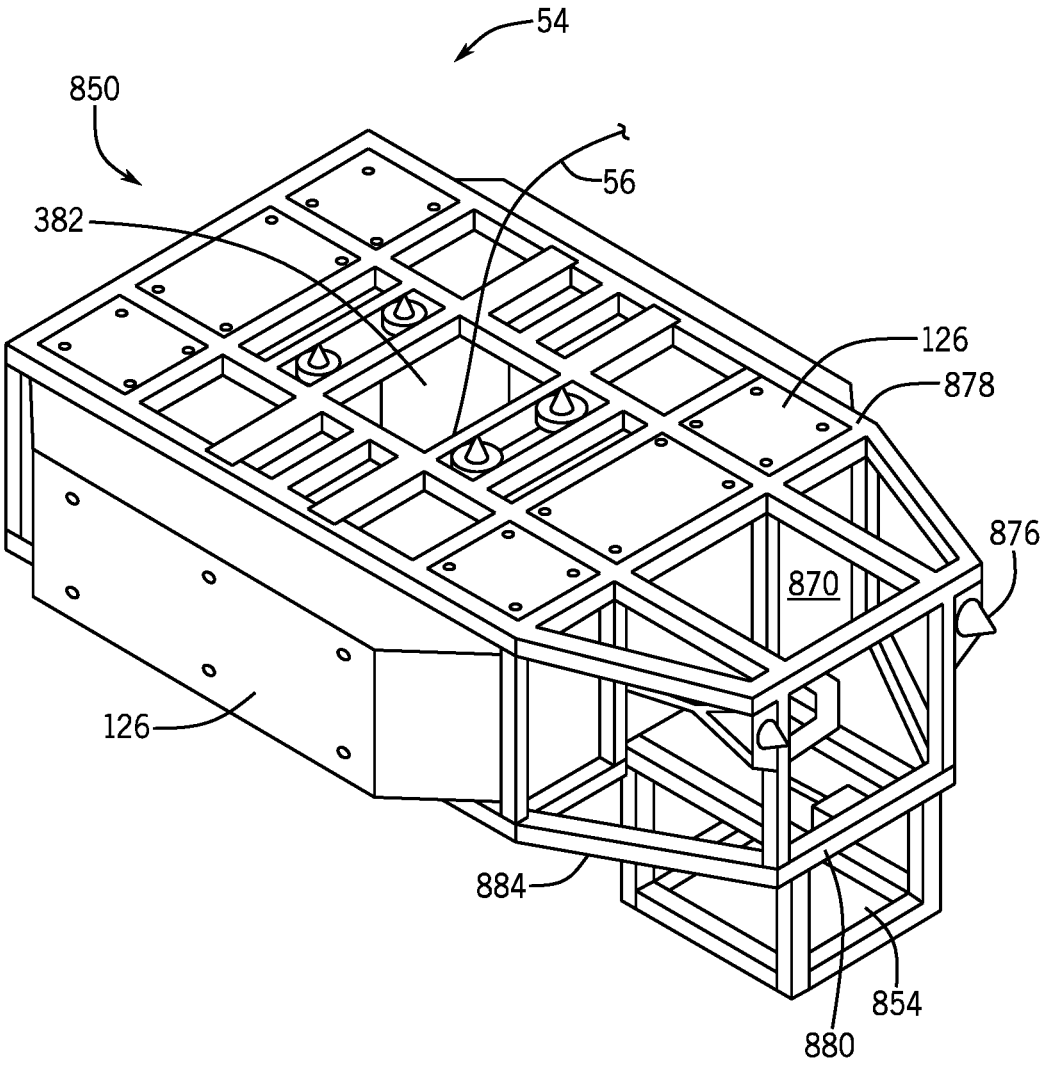
FIG. 31 is a perspective view of an embodiment of the ROV of FIG. 30.

FIG. 31 is a perspective view of an embodiment of the ROV 54 shown in FIG. 30. As illustrated, the ROV 54 includes the frame 878. Docking hardware 876 mounted to the frame 878 interfaces with complementary docking hardware 706 on the frame 700 shown in FIG. 26. As previously discussed, the docking hardware 706 shown in FIG. 26 is just one of many possible embodiments. Accordingly, the docking hardware 876 may take different forms in other embodiments. The ROV 54 also includes a bumper 880 to facilitate docking to the frame 700 and reduce damage or wear to the ROV frame 878 or the subsea frame 700. For example, the bumper 880 may include one or more shock absorption structures, such as one or more resilient portions (e.g., bumpers made of a resilient material such as rubber) or shock absorbers (e.g., piston-cylinder assemblies or fluid filled resilient bags). In the illustrated embodiment, a plurality of floatation devices 126 are disposed within the frame 878, rather than on top of the frame 878. However, the centers of mass of the various floatation devices may be disposed even with or above the center of mass of the rest of the ROV 54 and/or module 52, so as not to induce rolling. A central housing 882 may be disposed interior of the frame 878 and include many of the components and systems shown and described with regard to FIG. 30. For example, the central housing 882 may include all of or part of the communication circuitry 858, the ROV control system 860, the ROV power system 866, the ROV motion control system 868, the module coupling system 872, the exchange weight coupling system 874, etc. The thrusters 850 may be disposed at the rear of the ROV 54 and act under the control of the motion control system 868 to control the position of the ROV 54. As illustrated, module receptacle 870 may be disposed near the front of the ROV (e.g., in the tapered front portion 884) and configured to receive one or more modules 52. Once the ROV 54 docks with the subsea frame 700 (e.g., via the docking hardware 876), the module may be retrieved from, or transferred to, the module receptacle 702 of the subsea frame 700. In the illustrated embodiment, the ROV 54 also includes the exchange weight receptacle 854. However, in some embodiments, the ROV 54 may not include an exchange weight receptacle 854. In such an embodiment, the ROV 54 may rely entirely on floatation devices 126 mounted to the ROV 54 and/or the module 52 for buoyancy control. Accordingly, embodiments of the ROV 54 may utilize floatation devices 126, exchange weights 802, or a combination thereof to manage the buoyancy of the ROV 54.

Figure 32:
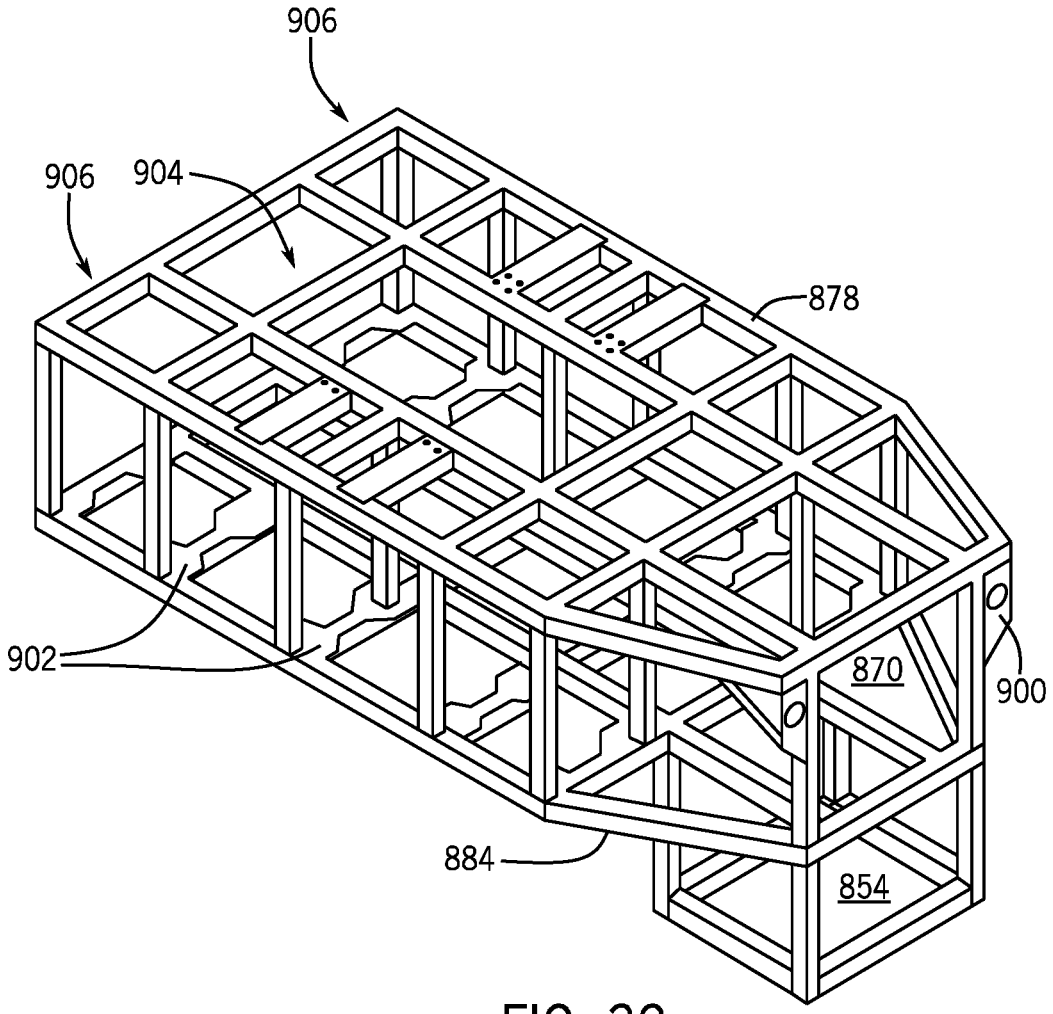
FIG. 32 is a perspective view of an embodiment of a frame of the ROV of FIG. 31.

FIG. 32 is a perspective view of the frame 878 of the ROV 54 shown in FIG. 31. As illustrated, the frame 878 includes docking hardware brackets 900 for mounting docking hardware 876. Similarly, the frame 878 may include mounting brackets 902, which may facilitate mounting floatation devices 126, thrusters 850, or central housings 882. As shown, a central channel 904 may be used for holding modules 52, central housings 882, and the like. Meanwhile, side channels 906 may be used for floatation devices 126.

Figure 33:
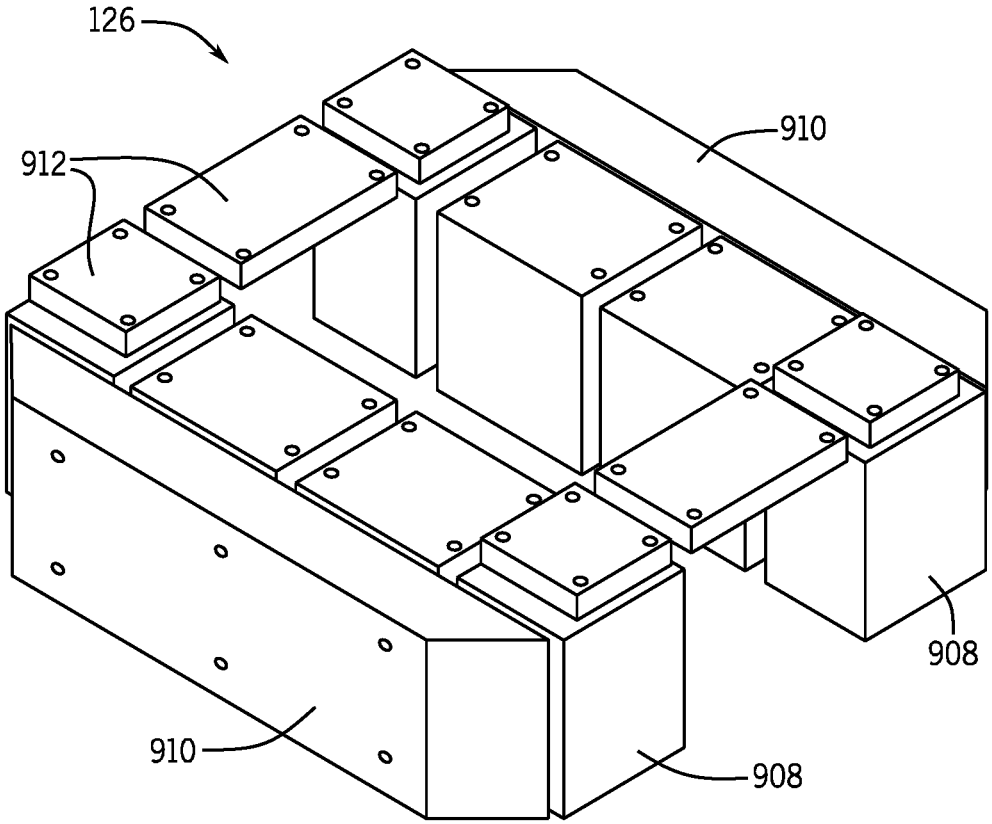
FIG. 33 is a perspective view of an embodiment of floatation devices of the ROV of FIG. 31.

FIG. 33 is a perspective view of the floatation devices 126 of the ROV 54 shown in FIG. 31. As illustrated, the floatation devices 126 may include multiple different kinds of floatation devices 126. For example, in the instant embodiment, the ROV 54 is equipped with internal floatation devices 908, side floatation devices 910, and top floatation devices 912. The internal floatation devices 908 are disposed within the frame 878. The side floatation devices 910 are coupled to the frame 878 but extend outward beyond the frame 878 toward either side of the frame 878. The top floatation devices 912 may be coupled to the frame 878 and disposed on top of the internal floatation devices 908. As previously discussed, the configuration shown in FIG. 33 (i.e., internal floatation devices 908, side floatation devices 910, and top floatation devices 912) is just one of many possible embodiments. In the illustrated embodiment, the floatation devices 126 are made of syntactic foam, but any other buoyancy-increasing material may be used. Furthermore, the floatation devices 126 may be selectively and removably coupled to the frame 878 of the ROV 54 (e.g., on-site or off-site) to tailor the buoyancy of the ROV 54 based on the expected payload.

Figure 34:
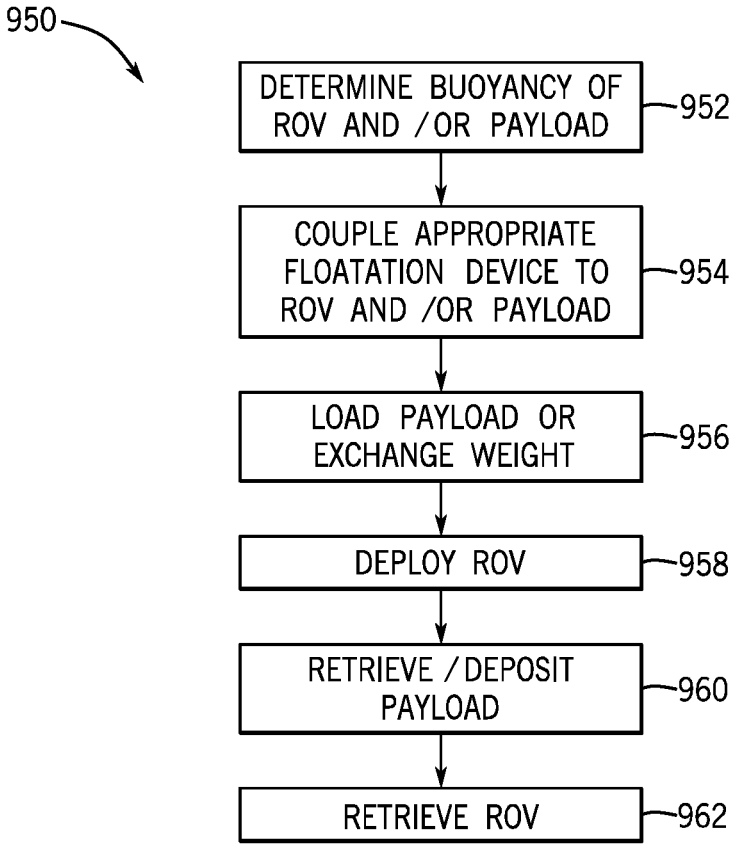
FIG. 34 is a flow chart of an embodiment of a process for controlling buoyancy of the ROV while depositing and/or retrieving the module.

FIG. 34 is a flow chart of a process 950 for controlling buoyancy of an ROV 54 while depositing and/or retrieving the module 52. In block 952, the buoyancy of the ROV 54 and/or module 52 is determined, either experimentally (e.g., water displacement test), or by measuring the mass and volume. As previously discussed, the motion control system 868 (e.g., one or more thrusters 850) of the ROV 54 may be capable of controlling the depth of the ROV 54 as long as the buoyancy of the package 852 is within a threshold value of neutrally buoyant. In some embodiments, if the package 852 as a whole, or the ROV 54 and module 52 individually, do not fall within the threshold value of neutrally buoyant, floatation devices 126 may be added to either the ROV 54, the module 52, or both (block 954) in order to achieve the desired buoyancies and buoyancy distribution. For example, blocks of syntactic foam may be coupled to the ROV 54 and/or the module 54 such that the combined package 852 and the individual elements of the package 852 (e.g., the ROV 54 and the module 52) may have buoyancies within a threshold range of neutrally buoyant such that the ROV motion control system 868 can control the depth of the ROV 54 with and without the module 52.

In block 956 of the process 950, the module 52 or the exchange weight 802 is loaded onto the ROV 54. If the ROV 54 is taking a module 52 down to deposit at a location, then the module 52 is loaded onto the ROV 54. Alternatively, if the ROV 54 is retrieving a module 52, then the ROV 54 may be loaded with an exchange weight 802. The mass of the exchange weight 802 may be determined based upon the mass of the module 52. For example, the exchange weight 802 may be selected such that the exchange weight 802 and the module 52 have substantially similar masses, such that the ROV motion control system 868 may be capable of controlling the depth of the ROV 54 when loaded with either the module 52 or the exchange weight 802.

In block 958 of the process 950, the ROV 54 is deployed from a location at or near the surface 42 or an intermediate docking station 58 to a location, diving a depth to a second location (e.g., a BOP stack 46 at or near the sea floor 16). Once the ROV 54 arrives at the location, the module 52 is deposited or retrieved (block 960). In some embodiments, the ROV 54 may couple (e.g., dock) to a structure 700 at the location (e.g., BOP stack 46) via docking hardware 876 under the control of the docking system 856. By docking to the BOP stack frame 700 or other structure, the ROV 54 may deposit or retrieve modules 52 and/or exchange weights 802 without maintaining a package 852 buoyancy within the threshold buoyancy of neutrally buoyant without the ROV 54 sinking or floating away. However, in some embodiments, the ROV 54 may not dock. Once the module 52 and/or exchange weight 802 have been deposited or retrieved, the ROV 54 may undock, if the ROV 54 previously docked to the BOP stack 46. The ROV 54 then returns to the location at or near the surface 42 or the intermediate docking station 58. The ROV 54 may then be retrieved (block 262) and unloaded.

The disclosed techniques include performing one or more functions of a subsea BOP stack with one or more ROV-retrievable modules. Each module may include one or more components or submodules that couple to a chassis core of the module. The module may also include connections (e.g., electrical, fluid, hydraulic, pneumatic, etc.) that provide an interface between the module and an adjacent module or the BOP stack. Accordingly, any function of the BOP stack could be modularized by performing the function with one or more ROV-retrievable modules. The modules may include ancillary systems, which may be added to existing BOP stacks, or primary systems incorporated into designs of new BOP stacks. If a module of the BOP stack breaks or malfunctions, rather than retrieving the entire BOP stack, taking the well off-line for two weeks or more, a replacement module may be assembled on the rig and an ROV may be sent down to retrieve the old module and install the new module, thus reducing the time the well is off-line to 1-2 days. Further, by assembling a replacement module for the malfunctioning module, the cause of the malfunction can be diagnosed and repaired after the well has been brought back on line. Thus, engineers tasked with repairing the BOP stack can work on repairs without stringent time constraints.

While the disclosed subject matter may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the disclosure as defined by the following appended claims.

The invention claimed is:

1. A system, comprising:

a blowout preventer (BOP) stack module, comprising:

a module frame configured to support a plurality of submodules, wherein each submodule of the plurality of submodules is configured to separately and directly couple to the module frame and to each other, the plurality of submodules wrap around an exterior perimeter of the module frame, the plurality of submodules are configured to perform a function on a BOP stack;

an underwater vehicle coupling hardware coupled to the module frame, wherein the underwater vehicle coupling hardware is configured to couple with an underwater vehicle configured to transport and selectively couple and uncouple the BOP stack module relative to the BOP stack;

a floatation device configured to manage the buoyancy of the BOP stack module as the underwater vehicle transports the BOP stack module underwater; and a mechanical connector coupled to the module frame, wherein the mechanical connector is configured to couple to a stack frame of the BOP stack; and at least one port coupled to the module frame, wherein the at least one port comprises a fluid port, a hydraulic port, a pneumatic port, an electrical port, or a combination thereof, wherein the at least one port is configured to couple with a corresponding port of the BOP stack.

2. The system of claim 1, wherein the plurality of submodules comprise a controller submodule having a processor, a memory, and instructions configured to perform one or more BOP functions.

3. The system of claim 1, wherein the plurality of submodules comprise a monitoring submodule having one or more sensors.

4. The system of claim 1, wherein the plurality of submodules comprises at least one of a filter submodule, a valve submodule, a fluid manifold submodule, a hydraulics submodule, an electronics submodule, a power submodule, a control submodule, or a combination thereof.

5. The system of claim 1, comprising a family of submodules configured to selectively couple with the module frame of the BOP stack module to customize the BOP stack module with one or more functions of the BOP stack.

6. The system of claim 1, wherein the underwater vehicle coupling hardware comprises a torque tool bucket configured to interface with a torque tool of the underwater vehicle, wherein the mechanical connector is configured to be actuated by the torque tool via the torque tool bucket.

7. The system of claim 1, wherein the module frame comprises a plurality of receptacles configured to receive and support the plurality of submodules.

8. The system of claim 1, wherein the plurality of submodules couple to an exterior surface of the module frame.

9. The system of claim 1, wherein the floatation device is coupled to the module frame.

10. The system of claim 9, wherein the floatation device is further configured to remain coupled to the module frame after the BOP stack module is coupled to the BOP stack.

11. A system, comprising:

a module frame of a BOP stack module;

a plurality of submodules of a family of submodules configured to selectively couple to the module frame of the BOP stack module to customize the BOP stack module with one or more functions of a BOP stack, wherein the BOP stack module is configured to removably couple with the BOP stack, and is transportable via an underwater vehicle;

a floatation device configured to manage the buoyancy of the BOP stack module as the underwater vehicle transports the BOP stack module underwater; and an alignment runner coupled to the module frame that is configured to facilitate installation and removal of the BOP stack module with the underwater vehicle.

12. The system of claim 11, wherein the plurality of submodules comprise a fluid submodule, an electronics submodule, a control submodule, an energy storage submodule, or any combination thereof.

13. The system of claim 11, wherein a fluid submodule of the plurality of submodules comprises a fluid passage, a fluid valve, a fluid manifold, a fluid filter, or any combination thereof.

14. The system of claim 11, wherein an energy storage submodule of the plurality of submodules comprises an electrical energy storage component, a fluid energy storage component, or a combination thereof.

15. The system of claim 11, comprising a plurality of BOP stack modules including the BOP stack module, wherein each of the plurality of BOP stack modules has a different configuration of submodules.

16. The system of claim 11, wherein the floatation device is coupled to the module frame.

17. The system of claim 16, wherein the floatation device is further configured to remain coupled to the module frame after the BOP stack module is coupled to the BOP stack.

18. A method, comprising:

selectively coupling a plurality of submodules of a family of submodules to each other and directly to a module frame of a BOP stack module to customize the BOP stack module with one or more functions of a BOP stack, the plurality of submodules wrap around an exterior perimeter of the module frame wherein the BOP stack module is configured to removably couple with the BOP stack via transport by an underwater vehicle; and coupling a floatation device to the module frame of the BOP stack module, the floatation device configured to manage the buoyancy of the BOP stack module as the underwater vehicle transports the BOP stack module underwater, and the floatation device further configured to remain coupled to the module frame after the BOP stack module is removably coupled to the BOP stack.

19. The method of claim 18, wherein selectively coupling the one or more submodules is performed on site at a surface rig above the BOP stack.

20. The method of claim 18, comprising coupling together two or more of the submodules on the BOP stack module via electrical connections, fluid connections, or a combination thereof.

* * * * *